US011426010B2

(12) United States Patent
Houston

(10) Patent No.: US 11,426,010 B2
(45) Date of Patent: Aug. 30, 2022

(54) SECOND SKIN SWADDLE

(71) Applicant: Sylvia Marie Houston, Loganville, GA (US)

(72) Inventor: Sylvia Marie Houston, Loganville, GA (US)

( * ) Notice: Subject to any disclaimer, the term of this patent is extended or adjusted under 35 U.S.C. 154(b) by 0 days.

(21) Appl. No.: 14/594,443

(22) Filed: Jan. 12, 2015

(65) Prior Publication Data

US 2016/0198865 A1 Jul. 14, 2016

(51) Int. Cl.
*A47D 13/02* (2006.01)

(52) U.S. Cl.
CPC ..... *A47D 13/02* (2013.01)

(58) Field of Classification Search
CPC ..... A47D 13/02; A41B 13/06; A41B 13/065; A41B 13/00
See application file for complete search history.

(56) References Cited

U.S. PATENT DOCUMENTS 4,144,593 A * 3/1979 Timmons ..... A41D 1/205 2/104
4,208,743 A * 6/1980 Whitcraft ..... A41D 1/205 2/104
4,458,365 A * 7/1984 Wood ..... A41D 1/205 2/104
5,071,047 A * 12/1991 Cordisco ..... A47D 13/025 224/158
5,440,763 A * 8/1995 Shah ..... A41D 13/1236 2/105
5,461,725 A * 10/1995 Witczak ..... A41D 1/205 2/104
D370,996 S * 6/1996 Shimura ..... D3/213
5,692,655 A * 12/1997 Fair ..... A47D 13/025 224/160
5,813,580 A * 9/1998 Fair ..... A47D 13/025 224/160
5,950,887 A * 9/1999 Powell ..... A47D 13/025 224/158
6,213,362 B1 * 4/2001 Lorenzini ..... A47D 13/02 224/158
6,343,727 B1 * 2/2002 Leach ..... A47D 13/02 2/102
6,536,047 B1 * 3/2003 Mullaly ..... A41B 13/06 2/48
6,595,396 B2 * 7/2003 Cummings ..... A47D 13/025 224/158
7,287,676 B2 * 10/2007 Chua ..... A41B 13/06 2/69
D672,546 S * 12/2012 Dror ..... D3/214
8,925,772 B2 * 1/2015 Vukovics ..... A47D 13/025 224/160
D738,614 S * 9/2015 Chapman ..... D3/214
D738,615 S * 9/2015 Chapman ..... D3/214
9,119,423 B2 * 9/2015 Gotel ..... A41B 13/065
9,138,071 B2 * 9/2015 Larch ..... A47D 13/025
D752,855 S * 4/2016 Halverstadt ..... D3/213
9,380,886 B2 * 7/2016 Rahni ..... A47D 13/02
D844,973 S * 4/2019 Gibbons ..... D3/214
(Continued)

*Primary Examiner* — Brian D Nash

(57) ABSTRACT

This Swaddle garment, the Second Skin Swaddle, is designed with a combination of simple and complex arches. These arches move and transition to support the mother and infant pre and post delivery. Multiple Swaddles sections are used to support hands-free holding for one or more infants.

7 Claims, 23 Drawing Sheets

(56) References Cited

U.S. PATENT DOCUMENTS 10,264,894 B2 * 4/2019 Gibbons ..... A47D 13/025
D930,355 S * 9/2021 Jeneske ..... D3/214
2005/0051582 A1 * 3/2005 Frost ..... A47D 13/025 224/160
2005/0077330 A1 * 4/2005 Fernandez ..... A47D 13/02 224/160
2005/0133551 A1 * 6/2005 Heidt ..... A47D 13/025 224/160
2005/0218168 A1 * 10/2005 Chua ..... A47D 13/025 224/160
2007/0278264 A1 * 12/2007 Chesal ..... A47D 13/02 224/160
2008/0149674 A1 * 6/2008 Hiniduma-Lokuge ..... A41D 1/215 224/159
2010/0200626 A1 * 8/2010 Moftakhar ..... A47D 13/025 224/160
2011/0108594 A1 * 5/2011 Davis ..... A41D 13/1245 224/623
2011/0240693 A1 * 10/2011 Parness ..... A47D 13/025 224/160
2012/0152987 A1 * 6/2012 Beltrame ..... A47D 13/025 224/158
2012/0234877 A1 * 9/2012 Hiniduma-Lokuge ..... A47D 13/025 224/159
2012/0248159 A1 * 10/2012 Rahni ..... A47D 13/02 224/158
2012/0286002 A1 * 11/2012 Dardel ..... A47D 13/025 224/159
2013/0200116 A1 * 8/2013 Arvan ..... A47D 13/02 224/158
2013/0291279 A1 * 11/2013 Jensen ..... A41D 27/20 2/69
2014/0084031 A1 * 3/2014 Bowden ..... A47D 13/025 224/158
2014/0231473 A1 * 8/2014 Bailey ..... A47D 13/025 224/160
2014/0283277 A1 * 9/2014 Wilhelm ..... A41B 13/00 2/69.5
2014/0284362 A1 * 9/2014 Halverstadt ..... A47D 13/02 224/159
2016/0206011 A1 * 7/2016 Houston ..... A47D 13/025
2016/0227847 A1 * 8/2016 Gibbons ..... A41D 3/08
2018/0228299 A1 * 8/2018 Gibbons ..... A47D 13/025
2018/0263857 A1 * 9/2018 Gibbons ..... A41D 1/215
2019/0075936 A1 * 3/2019 Salazar ..... A45F 3/047
2019/0133339 A1 * 5/2019 Gibbons ..... A47D 13/025

* cited by examiner

SECOND SKIN SWADDLE

RELATED APPLICATIONS

The present application is related to United States patent number US 2014/0283277 A1, issued Sep. 25, 2014, for MEDICAL WRAP FOR NEONATAL KANGAROO CARE, by Mariela Wilhelm, included by reference herein.

The present application is related to U.S. Pat. No. Des. 306,655, issued Mar. 20, 1990, for CARRIER FOR A BABY, by Arlette Schlegel, included by reference herein.

The present application is related to United States patent number US 2012/0234877 A1, issued Mar. 20, 2012, for INFANT CARRIER, by Prasanga D. hiniduma-Lokuge, included by reference herein.

The present application is related to U.S. Pat. No. 6,536, 047 B1, issued Mar. 25, 2003, for INFANT HOLDING GARMENT, by Kandi A. Mullaly, included by reference herein.

The present application is related to U.S. Pat. No. 4,567, 611, issued Feb. 4, 1986, for VEST FOR NURSING MOTHER, by Stephen Kendrick, included by reference herein.

The present application is related to U.S. Pat. No. 5,454, 498, issued Oct. 3, 1995, for BABY CARRIER, by Michelle L. Dunn, included by reference herein.

The present application is related to U.S. Pat. No. 6,343, 727 B1, issued Feb. 5, 2002, for ONE PIECE BABY CARRIER, by Jamie S. Leach, included by reference herein.

The present application is related to U.S. Pat. No. 6,213, 362 B1, issued Apr. 10, 2001, for SLING-TYPE INFANT CARRIER, by Ann. L. Lorenzini, Peter A. Christopher, included by reference herein.

The present application is related to United States patent number US 2013/0291279 A1, issued Nov. 7, 2013, for GARMENTS AND METHOD FOR CARRYING A BABY TO PROVIDE SKIN-TO-SKIN CONTACT, by Daniela Jenson, Hope Parish, included by reference herein.

The present application is related to U.S. Pat. No. 5,946, 725, issued Sep. 7, 1999, for ADULT INFANT BONDING GARMENT, by Ellen Shatzkin, Madeline Williams, included by reference herein.

The present application is related to U.S. Pat. No. 4,144, 593 A, issued Mar. 20, 1979, for FASHIONABLE NURSING GARMENT, by Suzanne D. Timmons, included by reference herein.

The present application is related to U.S. Pat. No. 4,208, 743 A, issued Jun. 24, 1980, for MOTHER'S GOWN WITH NURSING APERTURES, by Loni S. Whitcraft, included by reference herein.

The present application is related to U.S. Pat. No. 4,458, 365 A, issued Jul. 10, 1984, for NURSING GOWN OR GARMENT, by Mary E. Wood, included by reference herein.

The present application is related to U.S. Pat. No. 5,440, 763 A, issued Aug. 15, 1995, for MULTI-PURPOSE GOWN, by Ramesh M. Shah, Robert J. Demeter, included by reference herein.

The present application is related to U.S. Pat. No. 5,461, 725 A, issued Oct. 31, 1995, for GARMENT FOR NURSING WOMAN, by Pamela A. Witczak, included by reference herein.

The present application is related to United States patent number US DES. 370,996 S, issued Jun. 25, 1996, for BABY CARRIER, by Toshihide Shimura, Hiroaki Matsuda, included by reference herein.

The present application is related to U.S. Pat. No. 5,692, 655 A, issued Dec. 2, 1997, for SOFT CARRIER FOR A CHILD, by Paul F. Fair, Marjorie G. Harper, Cynthia R. Nelson, included by reference herein.

The present application is related to U.S. Pat. No. 5,813, 580 A, issued Sep. 29, 1998, for SOFT-SIDED INFANT CARRIER CONVERTIBLE TO HIP CARRIER, by Paul F. Fair, included by reference herein.

The present application is related to U.S. Pat. No. 5,950, 887 A, issued Sep. 14, 1999, for BABY SLING, by Karen L. Powell, included by reference herein.

The present application is related to U.S. Pat. No. 6,595, 396 B2, issued Jul. 22, 2003, for APPARATUS FOR CARRYING AN INFANT, by Quinn L Cummings, Amy M. Turner, included by reference herein.

The present application is related to United States patent number US 2005/0051582 A1, issued. Mar. 10, 2005, for BABY CARRIER, by Karin A. Frost, included by reference herein.

The present application is related to United States patent number US 2005/0077330 A1, issued Apr. 14, 2005, for CHILD SLING, by Joyce Fernandez, included by reference herein.

The present application is related to United States patent number US 2005/0133551 A1, issued Jun. 23, 2005, for CUSTOM FITTING, HANDS-FREE, BABY WRAP CARRIER ARTICLE FOR INFANTS AND TODDLERS, by Elizabeth Susan Heidt, included by reference herein.

The present application is related to United States patent number US 2007/0278264 A1, issued Dec. 6, 2007, for WEARABLE CARRIER AND METHOD OF CARRYING A CHILD OR ANIMAL, by Michal Chesal, Brian Chesal, Yitzie Wernick, Aviva Wernik, included by reference herein.

The present application is related to United States patent number US 2012/0286002 A1 issued Nov. 15, 2012, for BABY CARRIER, by Jerome Dardel, Shirley Pavlik, included by reference herein.

The present application is related to United States patent number US 2013/0200116 A1, issued Aug. 8, 2013, for INFANT SUPPORT GARMENT, by Julie Aryan, included by reference herein.

The present application is related to United States patent number US 2014/0284362 A1, issued Sep. 25, 2014, for INFANT CARRIER GARMENT, by Matthew C. Halverstadt, Katie A. Halverstadt, included by reference herein.

FIELD OF THE INVENTION

The present invention relates to . . . and, more particularly, to . . . A Swaddle garment is designed with a combination of simple and complex arches. These arches move and transition to support the mother and infant pre and post delivery to support the infant in the breast crawl, the "Natural Breastfeeding position", allowing easy of infant to the breast from the upright position of Skin to Skin Contact.

BACKGROUND OF THE INVENTION

Research has shown multiple benefits of Skin-to-Skin contact for both the newborn and mother. These findings led to Joint Commissions' mandating changes in newborn care immediately following delivery and in the postpartum phase. These changes have produced challenges for Birthing Centers now faced promoting Skin-to-Skin contact while increasing supplemental breastfeeding, and exclusive breastfeeding results, in the face of decreasing accidental infant falls and Sudden Unexpected Postnatal Collapse ("SUPC") incidents.

Risk Factors of the Mother-Infant Dyad:

Maternal risk factors: "fatigue, sedation, primiparous, distraction, on narcotic meds, history of smoking, obese/pendulous breasts." i.e. 1

Infant risk factors: falls, exposure when infant is passed around the room by guests and incorrect positioning, "Position of the infant is a key factor to minimizing risk of Sudden Unexpected Postnatal Collapse. Sudden Unexpected Postnatal Collapse is an emerging complication of Skin-to-Skin contact and breastfeeding the first hours and days post birth." i.e. 2

Environmental risk factors: "Breastfeeding, intermittent observation, unsafe and/or prone positioning, failure to model and reinforce safe sleep practice." i.e. 3

To help meet these challenges, we are exploring the use of the Second Skin Swaddle, designed for the mother to safely hold and position her infant in Skin-to-Skin contact, while providing the mother comfort and discretion.

The Second Skin Swaddle is designed to safely hold infant in Skin-to-Skin contact. The Second Skin Swaddle supports the infant in the upright position between the breasts and allows the newborn to easily move to the breastfeeding position for optimum Latch and Baby Led Breastfeeding. Nurses have reported that the mother went from stressed to relaxed when she wore the Second Skin Swaddle.

The Second Skin Swaddle adapts for the NICU unit in birthing centers.

Below is information on Skin-to-Skin contact cited from Dr. Susan Ludington's article in *Newborn & Infant Nursing Reviews* (2013).

Dr. Susan Ludington Hoe is the leading researcher worldwide in Skin-to-Skin care, also known as Kangaroo Care. Her tireless efforts and contributions of over 25 years have helped bring great advances in mother and infant care worldwide.

Skin-to-Skin contact ("SSC"), also known as Kangaroo Care, has been recommended for all healthy term newborns by the American Academy of Pediatrics, 1; The American College of Obstetricians and Gynecologist, 2; the Centers for Disease Control and Prevention, 3; and, the Academy of Breastfeeding Medicine, 4, because of SSC's numerous positive effects in infants and their families. 5 Skin-to-Skin contact's ability to regular the infant's temperature and prevent hypothermia and hypoglycemia has earned SSC recognition in the Neonatal Resuscitation Program as the first step for all healthy term infants who do not require resuscitation. 6 Other profound and undisputed effects of SSC are improvement in initiation, duration, and exclusivity of breastfeeding and enhanced milk production. 7 Because of these lactation effects, provision of SSC beginning immediately after birth and continuing until the first feeding at the breast is finished has been identified as the essential first step for meeting Healthy People 2020 breastfeeding goals, 8 the Association of Women's Health, Obstetric and Neonatal Nurses' perinatal core measures for excellent care, 9 and the new Joint Commission mandate that all healthy term infants born in hospitals delivering 1100 or more infants/year are exclusively breast milk fed by discharge. 10, 11 Continuing SSC throughout postpartum may yield or increase exclusive breast milk feedings at discharge. 1, 12

*Ludington-Hoe S M, Morgan K. Infant Assessment and Reduction of Sudden Unexpected Postnatal Collapse Risk During Skin-to-Skin Contact. *Newborn & Infant Nursing Reviews* (2013).

Additional organizations recommending Skin-to-Skin contact for full term infants are in the references:

Agency for Health Research and Quality, 13
International Confederation of Midwives, 21
American Academy of Family Practice, 14
International Lactation Consultants Association, 22
American College of Nurse Midwives, 15
Lamaze International, 23
American Dietetic Association, 15
National Perinatal Association, 24
American Heart Association, 17
Office on Women's Health, US Depart. of Health, 25
California Department of Health Services, 18
Office of the Surgeon General Public Health, 26
Childbirth Connection, 19
United States Breastfeeding Committee, 27
Coalition for Improving Maternity Services, 20

Excerpts From:

A Comprehensive Evidence-Based Review of Skin-to-Skin (Kangaroo) Care with Full-term Infants, Susan M. Ludington-Hoe, R.N., CNM, Ph.D.; FAAN; Barbara Morrison, R.N., CNM, FNP, Ph.D.; Gene Cranston Anderson, R.N., Ph.D., FAAN "Keep the infant in KC at least until the first suckling at the breast has been accomplished." (Sinusas & Gagliardi, 2001; Warren, 2008).

"Kangaroo Care increases oxytocin release in both mother and infant. Oxytocin, in turn, facilitates breastfeeding, bonding, maternal relaxation, uterine contractions, and minimization of stress." (Dordevic, et al., 2008; Uvnas-MobergSuckling maintains development, 2003; Uvnas-Moberg, et al., 2005).

"Suckling induces production of the anterior pituitary's prolactin-secreting cells even when estrogen drops at cell integrity. Suckling also induces prolactin surges in maternal blood, supporting normal lactation." (Uvnas-Moberg, 1999; Uvnas-Moberg, 2003).

"The colostrum delivered with the initial sucks is rich in T and B lymphocytes, enhancing infant immunity."

"Also, sending the infant to the observation nursery at any time during the postpartum is detrimental because once the infant is in the nursery, treatments, physical assessments, and screenings get clustered together and result in prolonged separation from the mother." (Vazquez & Berg, 2012).

Conducting these procedures at the mother's bedside is the best practice.

"Have the mother provide continuous KC until discharge. Mother and infant should remain in KC as much as possible throughout the postpartum stay for improved interactions, development, and breastfeeding." (Kent, et al., 2012; Vasquez & Berg, 2012).

"Continued KC as much as possible throughout the first three months of life." (Chalmers, O'Brien, & Boscoe, 2009).

Use KC as a FIRST intervention for breastfeeding problems. (Vazquez & Berg, 2012).

"Remember, Kangaroo Care is the newborn's playground." (Winberg, 2005). Birth—a condition that threatens prolactin.

Kangaroo Care's continual use throughout the mother's day can be accomplished using tube top, slings, or wraps to position the infant near the breast while maintaining maternal modesty as the mother conducts routine postpartum activities.

Purposes:

Increase the duration of healthy term infants being held Skin-to-Skin during their mothers' postpartum hospitalization, 10, by using the Second Skin Swaddle.

Increase Breastfeeding and Exclusive Breastfeeding, because when the infant is in the right habit environment, Baby-Led breastfeeding is facilitated and the infant can easily move to the breastfeeding position in the Second Skin Swaddle.

Decrease falls and SUPC incidents, because the infant is secured by the Second Skin Swaddle in the upright position between the mother's breasts or in the breastfeeding position.

One Piece baby carrier—U.S. Pat. No. 6,343,727 B1

Adult Infant Bonding Garment—U.S. Pat. No. 5,946,725

Baby Carrier—U.S. Pat. No. 5,454,498

Vest for a Nursing Mother—U.S. Pat. No. 4,567,611

Medical Wrap for Neonatal Kangaroo Care—Pub. No.: US 2014/0283277

Sling Type Infant Carrier—U.S. Pat. No. 6,213,362 B1

Garments and Methods for Carrying a baby to provide Skin-to-Skin Contact—Pub. No.: US 213/0291279 A1

Infant Holding Garment—U.S. Pat. No. 6,536,047 B1

Infant Carrier—Pub. No.: US 2012/0234877 A1

Carrier for Baby—Patent No.: DES. 306,655

Fashionable Nursing Garment—Patent No.: US 1979/4,144,593 A

Mother's Gown with Nursing Apertures—Patent No.: US 1980/4,208,743 A

Nursing Gown or Garment—Patent No.: US 1984/4,458,365 A

Multi-Purpose Gown—Patent No.: US 1995/5,440,763 A

Garment for Nursing Woman—Patent No.: US 1995/5,461,725 A

Baby Carrier—Patent No.: US DES. 1996/370,996 S

Soft Carrier fora Child—Patent No.: US 1997/5,692,655 A

Soft-Sided Carrier Infant Carrier Convertible to Hip Carrier—Patent No.: US 1998/5,813,580 A Baby Sling—Patent No.: US 1999/5,950,887 A Apparatus for Carrying an Infant—Patent No.: US 2003/6,595,396 B2

Baby Carrier—Patent No.: US 2005/0051582 A1

Child Sling—Patent No.: US 2005/0077330 A1

Custom Fitting, Hands-Free, Baby Wrap Carrier Article for Infants and Toddlers—Patent No.: US 2005/0133551 A1

Wearable Carrier and Method of Carrying a Child or Animal—Patent No.: US 2007/0278264 A1

Baby Carrier—Patent No.: US 2012/0286002 A1

Infant Support Garment—Patent No.: US 2013/0200116 A1

Infant Carrier Garment—Patent No.: US 2014/0284362 A1

Related Applications as Applied to Second Skin Swaddle:

One Piece Baby Carrier—U.S. Pat. No. 6,343,727 B1

This application is not designed for Skin-to-Skin Contact as is Second Skin Swaddle This application not designed to support an infant in the upright position, which is the recommended position for all babies as is Second Skin Swaddle This application does not support breastfeeding as does the Second Skin Swaddle This garment has armholes, which can be constricting. The Second Skin Swaddle allows mobility.

This garment has inflexible ties, which could be constricting and uncomfortable for the mother and the infant. The Second Skin Swaddle does not have ties.

The fleece mentioned in this application would not expand. The Second Skin Swaddle is made of an expandable jersey material.

Adult Infant Bonding Garment—U.S. Pat. No. 5,946,725

This application offers no neck support for infant as does the Second Skin Swaddle Pouch confines infant to only one position Pouch restricts the size and movement of infant Infant is to be slid down into the garment The pouch is negative because there is fabric between mother and infant, prohibiting heat transfer:

Baby Carrier—U.S. Pat. No. 5,454,498

The babies' faces are not visible

Infant's legs should not be put through any openings or spread apart

Vest for a Nursing Mother—U.S. Pat. No. 4,567,611

Not designed for Skin-to-Skin Contact

Not a breathable material

Uses a lot of buttons which are not stable

Medical Wrap for Neonatal Kangaroo Care—Pub. No.: US 2014/0283277

Claims of Skin to Skin but inconclusive results

Sling Type Infant Carrier—U.S. Pat. No. 6,213,362 B1

Infant not supported

Does not support breastfeeding

Garments and Methods for Carrying a baby to provide Skin-to-Skin Contact—Pub. No.: US 2013/0291279 A1

No neck support

Pouch confines infant to only one position

Pouch restricts the size and movement of infant

Infant is to be slid down into the garment

The pouch is negative because there is fabric between mother and infant, prohibiting heat transfer.

Infant Holding Garment—U.S. Pat. No. 6,536,047 B1

No Skin-to-Skin Contact

No back or neck support for the mother

No neck support for the infant

No breastfeeding options

Infant Carrier—Patent No.: US 2012/0234877 A1

Claims of Skin-to-Skin but inconclusive results

Carrier for Baby—Patent No.: DES. 306,655

Does not support the infant at all, except to carry some of the infant's weight.

Fashionable Nursing Garment—Patent No.: US 1979/4,144,593 A

Skin to Skin is not mentioned nor is safe hold or independent infant motivated movement possible.

Mother's Gown with Nursing Apertures—Patent No.: US 1980/4,208,743 A

It is only a breastfeeding gown.

Nursing Gown or Garment—Patent No.: US 1984/4,458,365 A

Exclusively a nursing gown.

Multi-Purpose Gown—Patent No.: US 1995/5,440,763 A

This a medical gown by design which can be adapted for breastfeeding.

Does not support an infant nor does it support Skin to Skin Contact

Requires an infant be held in the correct position in order to breastfeed

This invention concentrates on easy access to breastfeed, modest coverage;

Does not support hands-free infant holding Skin to Skin, or secure positioning for breastfeeding Garment for Nursing Woman—Patent No.: US 1995/5,461,725 A Exclusively a garment for breastfeeding; not for skin to skin holding.

"Baby Carrier—Patent No.: US DES. 1996/370,996 S

A carrier only.

Soft Carrier for a Child—Patent No.: US 1997/5,692,655 A

A child carrier only with lunge straps to keep the child from pushing away from the person wearing the carrier.

Not identified as for newborn or infant.

The garment does not support breastfeeding or skin to soft-Sided Carrier Infant Carrier Convertible to Hip Carrier—Patent No.: US 1998/5,813,580 A A multi-positional infant carrier only.

Does not provide for breastfeeding, skin to skin, infant motivated/directed movement to breastfeed.

Baby Sling—Patent No.: US 1999/5,950,887 A

Allows for a baby to be held against the wearers body but does not provide for or support breastfeeding, skin to skin, cannot be worn in delivery, does not allow infant motivated movement, infant is held in only one position unless repositioned by wearer, Does not allow for multi-positional infant motivated movement.

Apparatus for Carrying an Infant—Patent No.: US 2003/6,595,396 B2

Does not provide for or support breastfeeding, skin to skin, cannot be worn in delivery, Does not allow infant motivated movement, infant is held in only one position unless repositioned by wearer, does not allow for multi-positional infant motivated movement.

Baby Carrier—Patent No.: US 2005/0051582 A1

It is a baby carrier to be worn over clothing prohibiting Skin to Skin Contact.

Does not provide head and neck support for infant.

Does not position infant in the natural breastfeeding position, parallel to mother with infant's body fully extended and on the upper side of breast with nose in sniffing position.

It does not support immediately after birth for the baby to freely move in the breast crawl.

Have to thread through infant's legs.

It is too complicated for use in the postpartum use in the hospital.

Does not allow for hands-free expression of breastmilk.

Does not allow for hands-free expression of breastmilk while holding infant in upright Skin to Skin Contact position.

Does not allow for multi-positional infant motivated movement.

Child Sling—Patent No.: US 2005/0077330 A1

It is a sling to be worn over clothing prohibiting Skin to Skin Contact.

Does not provide head and neck support for infant.

Does not position infant in the natural breastfeeding position, parallel to mother with infant's body fully extended and on the upper side of breast with nose in sniffing position.

It does not support immediately after birth for the baby to freely move in the breast crawl.

It is too complicated for use in the postpartum use in the hospital.

Does not allow for hands-free expression of breastmilk.

Does not allow for hands-free expression of breastmilk while holding infant in upright Skin to Skin Contact position.

Custom Fitting, Hands-Free, Baby Wrap Carrier Article for Infants and Toddlers—Patent No.: US 2005/0133551 A1

It is a baby carrier to be worn over clothing prohibiting Skin to Skin Contact.

Does not provide head and neck support for infant.

Does not position infant in the natural breastfeeding position, parallel to mother with infant's body fully extended, and on the upper side of breast with nose in sniffing position.

Have to thread through infant's legs.

It does not support immediately after birth for the baby to freely move in the breast crawl.

It is too complicated for use in the postpartum use in the hospital.

Does not allow for hands-free expression of breastmilk.

Does not allow for hands-free expression of breastmilk while holding infant in upright Skin to Skin Contact position.

Wearable Carrier and Method of Carrying a Child or Animal—Patent No.: US 2007/0278264 A1

It is a baby carrier to be worn over clothing prohibiting Skin to Skin Contact.

Does not provide head and neck support for infant.

Does not position infant in the natural breastfeeding position, parallel to mother with infant's body fully extended and on the upper side of breast with nose in sniffing position.

It does not support immediately after birth for the baby to freely move in the breast crawl.

It is too complicated for use in the postpartum use in the hospital.

Does not allow for hands-free expression of breastmilk.

Does not allow for hands-free expression of breastmilk while holding infant in upright Skin to Skin Contact position.

Does not cover mother's torso for discretion for Skin to Skin Contact.

Baby Carrier—Patent No.: US 2012/0286002 A1

Itis a baby carrier to be worn over clothing prohibiting Skin to Skin Contact.

Does not provide head and neck support for infant.

Does not position infant in the natural breastfeeding position, parallel to mother with infant's body fully extended and on the upper side of breast with nose in sniffing position.

It has a tie that could become untied.

It does not support immediately after birth for the baby to freely move in the breast crawl.

It is too complicated for use in the postpartum Use in the hospital.

Does not allow for hands-free expression of breastmilk.

Does not allow for hands-free expression of breastmilk while holding infant in upright Skin to Skin Contact position.

Infant Support Garment—Patent No.: US 2013/0200116 A1

It has a fabric pocket for infant prohibiting Skin to Skin Contact.

Does not allow the infants feet and legs to naturally extend. This is critical for breastfeeding and in the breast crawl.

Does not provide head and neck support for infant.

Does not position infant in the natural breastfeeding position, parallel to mother with infant's body fully extended and on the upper side of breast with nose in sniffing position.

It does not support immediately after birth for the baby to freely move in the breast crawl.

It is too complicated for use in the postpartum use in the hospital.

Does not allow for hands-free expression of breastmilk.

Does not allow for hands-free expression of breastmilk while holding infant in upright Skin to Skin Contact position.

Infant Carrier Garment—Patent No.: US 2014/0284362 A1

It has a receptacle that confines the position of the infant not allowing freedom of natural movement.

For the natural breastfeeding position the infant is parallel to mother with infant's body fully extended and on the upper side of the breast and nose in sniffing position. The receptacle does not allow for this movement.

The receptacle does not lower for the infant to breastfeed. The infant's body has to lower to the waist and shift to the side for correct latch to naturally breastfeed.

There is no flexible support for the head and neck for breastfeeding.

Have to thread legs through holes in seat receptacle.

It does not support immediately after birth for the baby to freely move in the breast crawl.

It is too complicated for use in the postpartum use in the hospital.

Does not allow for hands-free expression of breastmilk.

Does not allow for hands-free expression of breastmilk while holding infant in upright Skin to Skin Contact position.

SUMMARY OF THE INVENTION

In accordance with the present invention, there is provided . . . Second Skin Swaddle Summary.

This Swaddle garment is designed with a combination of simple and complex arches. These arches move and transition to support the mother and infant pre and post delivery to support Skin to Skin Contact for correct positioning and movement of the infant.

The basic Parabolic Arch shape of the Swaddle has a short back and long arched front. The Swaddle body is joined by stretch seam at center front and center back. The Convex Arches form the upper and lower front. The Concave Arches form the upper and lower back. The shapes of the upper and lower sides of the Swaddle are that of a Parallel Arch which gives flexibility as each side pivots between the Convex Arch front and the Concave Arch back on both the upper and lower sides.

The parabolic Arch shape of the Swaddle becomes a Circular Arch when placed on mother as it conforms to her natural arches encircling her body which is the axis for the Swaddle. The short straight back becomes a vertical Concave Arch as it conforms to the curvature of the mother's body. The Circular Arch gives vertical and horizontal support for the infant's torso and forms an Arcade of Arches when the infant is placed in the Swaddle with spring-line points of support at the base of infant's neck and head, beneath the infant's bottom, beneath the infant's feet.

There are four, 3 Point Hinged Arches in the Swaddle: with one each in the center of the upper and lower front and back at the seam, with spring lines of support in the center, to the right and to the left of center front and center back seam. The 3 Point Hinged Arch gives vertical and horizontal support to the upper front for the head and neck of the infant and the lower front supports the infant's feet and legs.

The Cascade of the Convex Arches is formed by the expansion of fabric when the infant is placed in the Swaddle. This forms an accordion fold expansion providing the flexible horizontal and vertical support needed for the infant's head and neck in various newborn movements.

The multi-flex breathe-through fabric enables easy infant movement preventing infant breathing restriction. This stretch of the fabric works in tandem with the arches to safely and flexibly support the positioning of the infant to provide comfort and safety.

The Swaddle allows the infant to lunge up to 6" to and from mother's body during the Breast Crawl occurring immediately after birth for 60 to 90 minutes. This activates a number of arches of support, the Circular Arch, the Arcade of Arches 26, support the torso of the infant. The Convex Cascade of Arches, the 3 Point Hinged Arch support the head and neck. These arches work in tandem to support the infant's upper and mid torso. The Circular Arch, Convex Arch, and the 3 Point Hinged Arch work in tandem to flexibility support the infant's lower torso to prevent flipping and falling.

The infant can easily transition from the upright Skin to Skin position to the breastfeeding position. The infant's head and neck are flexibly supported horizontally by the Cascade of Arche working in tandem with the 3 Point Hinged Arch, to support the infant on the upper side of the breast, with head and nose in sniffing position. The vertical and horizontal support of The Circular Arch and the Arcade of Arches, provide vertical and horizontal support of the infant's torso. Work in tandem with multi-flex fabric and the stretch seams to allow the torso of the infant to easily move without sliding down into the body of the Swaddle. The length of the Swaddle Body 10 completely covers and supports the infant when infant's torso is fully extended and parallel to mother. The Convex Arch, the 3 Point Hinged Arch, flexibly supports the infant's feet and legs to promote successful breastfeeding.

The Parallel Arches of the upper and lower sides pivot between the Convex Arch of the front Concave Arch of the back on both the upper and lower sides for easy and comfortable movement of the Swaddle to the shoulder position.

When the Swaddle is placed on the shoulder a pouch is formed. The weight of the infant and the tension placed on the shoulder side of the Swaddle tighten the Convex Arches of the upper and lower fronts of the Swaddle to form a pouch. This pouch evenly distributes the weight of the infant due the Circular Arch, the multi-flex fabric and the arched stretch seam. The Cascade of Convex Arches are formed in accordion like folds support infant's neck and head for easy and safe movement.

When the second Swaddle is placed over the first, covering infant and mother gives more support for infant and mom. The Circular Arch, the 3 Point Hinged Arch is activated in the center front of both sections. The Convex Cascade of Arches is formed in both sections giving additional support for infant's head and neck.

The Second Swaddle is pulled up on opposite shoulder forming a second pouch over the first pouch. The Convex Cascade of Arches, the 3 Point Hinged Arch gives support to the head and neck. The two Swaddles give the support needed for the infant to be carried and allow mother to be hands free. The twist in the shoulder tightens the edges of the Convex Arches.

A twist is formed in the shoulder fabric to tighten the upper and lower edges of the front Convex Arches.

Two sections of the Swaddle will hold infant hands-free, with pouches formed in both Swaddles by the weight of the infant and the tension placed on the Convex Arches, when the side of the swaddle is placed on the shoulder. The Circular Arch works in tandem with the Parallel Arches, the Arcade of Arches, the multi-stretch fabric and stretch seams to give even weight distribution without creating pressure points. The Cascade of Convex Arches in combination with the 3 Point Hinged Arches provides flexible support for the infant's neck and head. The back of the Swaddle gives support for the moms back when two sections are worn for the active hold. The Parallel Arches of the upper and lower sides pivot between the Convex Arch and the Concave Arch of the upper and lower edges for movement of the Swaddle to the shoulder and other positions. The 3 Point Hinged Arches of both sides of the upper and lower back, allow easy movement for comfort and support in the crossover back.

Pumping hands free is possible because of the tension placed on the Convex Arches when the side of the Swaddle is placed on the shoulder to hold the flanges of the breast pump with or without holding the infant.

The addition of the third Swaddle section is added to hold twins.

The Swaddle body can be knitted as one piece, meeting the outlined descriptions of the seamed garment.

The "Second Skin Swaddle" invention garment design, combined with other features, aspects and advantages, are best understood when referenced to the attached drawings, descriptions and claims.

BRIEF DESCRIPTION OF THE DRAWINGS

A complete understanding of the present invention may be obtained by reference to the accompanying drawings, when considered in conjunction with the subsequent, detailed description, in which.

For purposes of clarity and brevity, like elements and components will bear the same designations and numbering throughout the Figures.

DESCRIPTION OF THE PREFERRED EMBODIMENT

The following detailed description represents the best currently contemplated modes for carrying out the invention. The description is not to be taken in a limiting sense, but is made merely for the purpose of illustrating the general principles of the invention.

This Swaddle garment is designed with a combination of simple and complex arches. These arches move and transition to support the mother and infant pre and post delivery. Multiple Swaddles sections are used to support hands-free holding for one or more infants.

Figure 1:
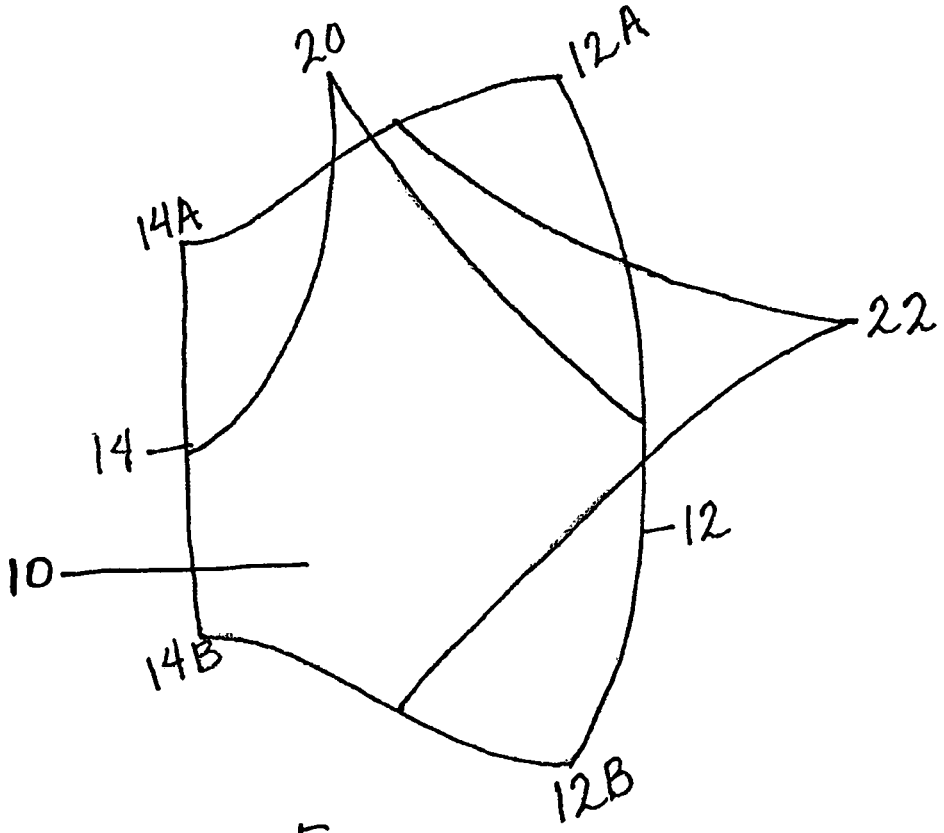
FIG. 1 is a side view of the Swaddle body 10 forming the Parabolic Arch 20 consisting of a vertical arched front 12 between 12A and 12B and a straight back 14 between 14A and 14B.

FIG. 1 is a side view of the Swaddle body 10 forming the Parabolic Arch 20 consisting of a vertical arched front 12 between 12A and 12B and a straight back 14 between 14A and 14B. The upper and lower sides of Swaddle body 10 are Parallel Arches 22 extending from 12A to 14A and 12B to 14B.

Figure 2:
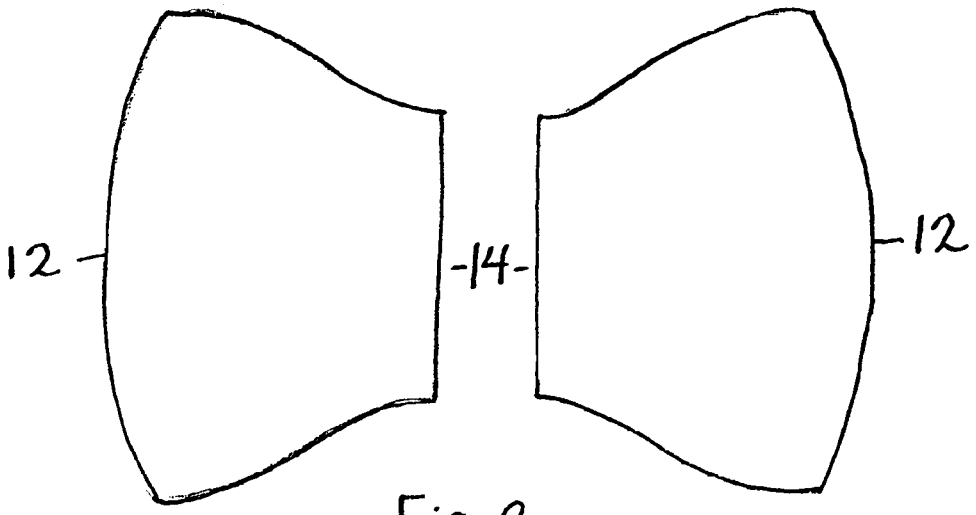
FIG. 2 shows the two flat sections of the Swaddle before being joined in back at 14 and in front at 12.

FIG. 2 shows the two flat sections of the Swaddle before being joined in back at 14 and in front at 12.

Figure 3:
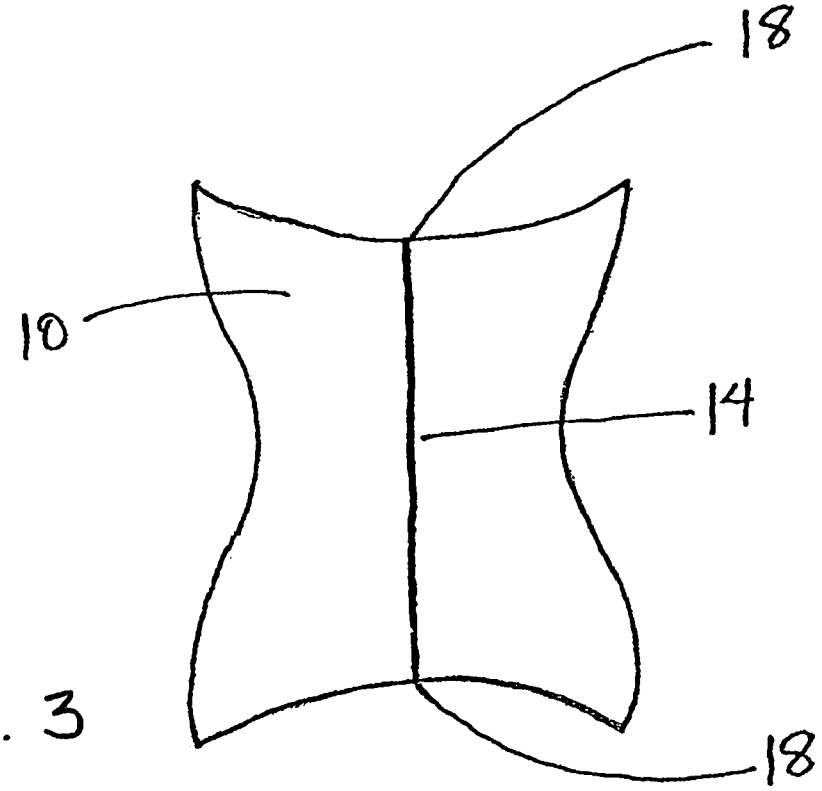
FIG. 3 is a back view of the Swaddle body 10 joined by stretch seam at 14

FIG. 3 is a back view of the Swaddle body 10 joined by stretch seam at 14. The upper backs form a Concave Arch 18 in both the upper and lower back. The Swaddle body completely encircles mother. The Swaddle body 10 can also be knitted as one piece, meeting the outlined descriptions of the seamed garment.

Figure 4:
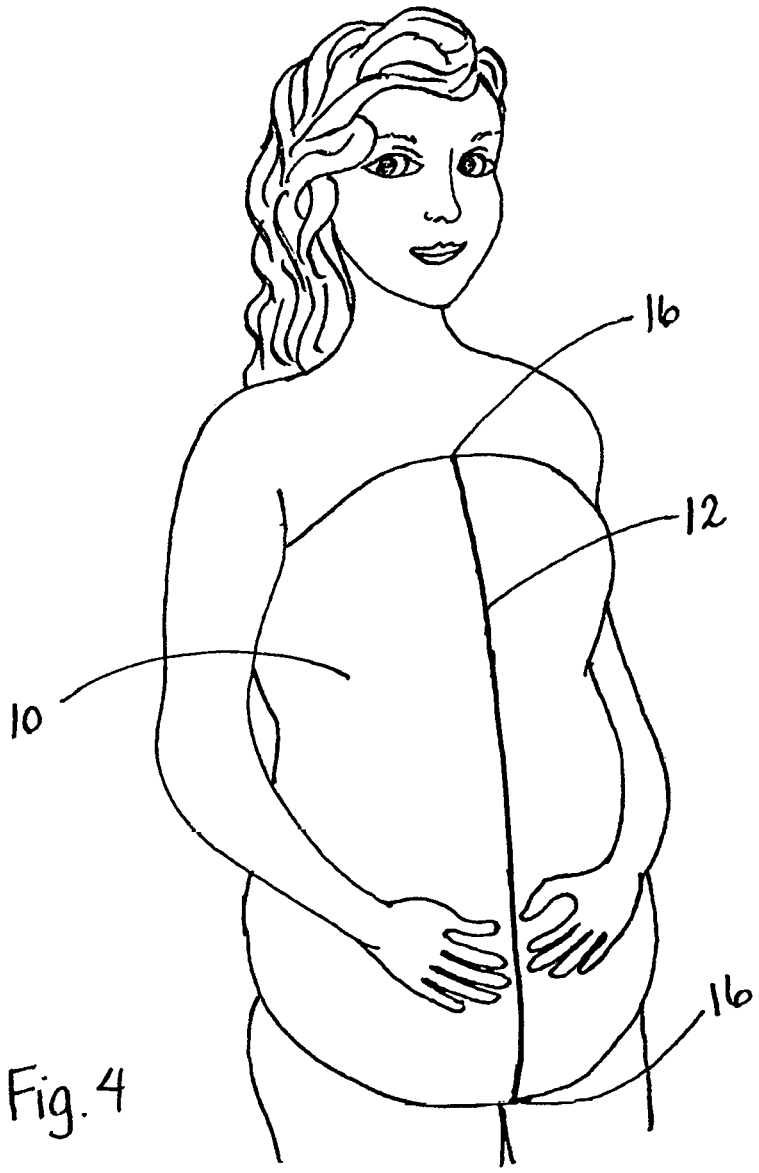
FIG. 4 is a front view of the Swaddle body 10 as worn by mother consisting of two identical sections joined in the center front at 12 and the center back at 14 by stretch seams.

FIG. 4 is a front view of the Swaddle body 10 as worn by mother consisting of two identical sections joined in the center front at 12 and the center back at 14 by stretch seams. The front upper side and front lower sides form Convex Arches 16.

Figure 5:
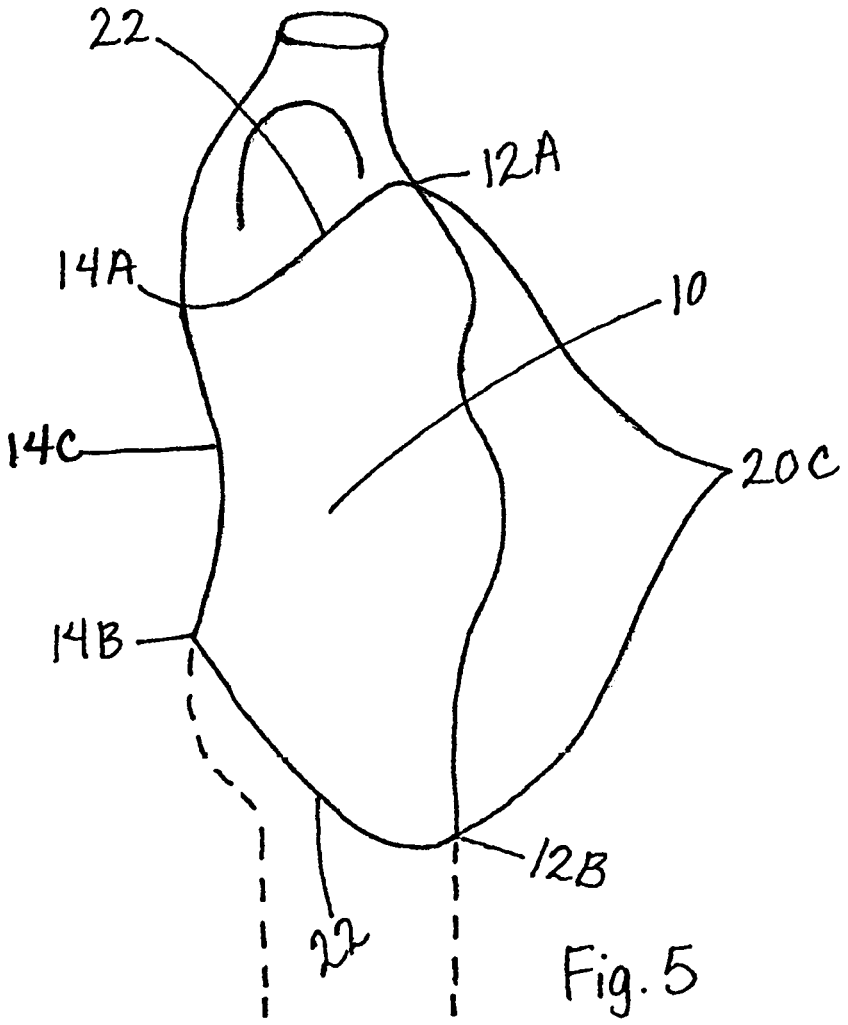
FIG. 5 is a side view of the Swaddle 10 on the mother's body.

FIG. 5 is a side view of the Swaddle 10 on the mother's body. The Parabolic Arch 20 becomes a Circular Arch 20C, conforming to the natural arches of mother and encircling her body which is the axis for the Circular Arch 20C. The Parallel Arch 22 shapes the upper and lower sides of the Swaddle running from 12A to 14A and 12B to 14B. The Parallel Arches 22 give flexibility as each pivot between the Convex Arched front and the Concave Arched back on both the upper and lower sides. The straight back 14 conforms to the curvature of the mother's body and becomes a Concave Arch 14C between 14A and 14B. The Circular Arch 20C front gives vertical and horizontal support for the infant's torso.

Figure 6:
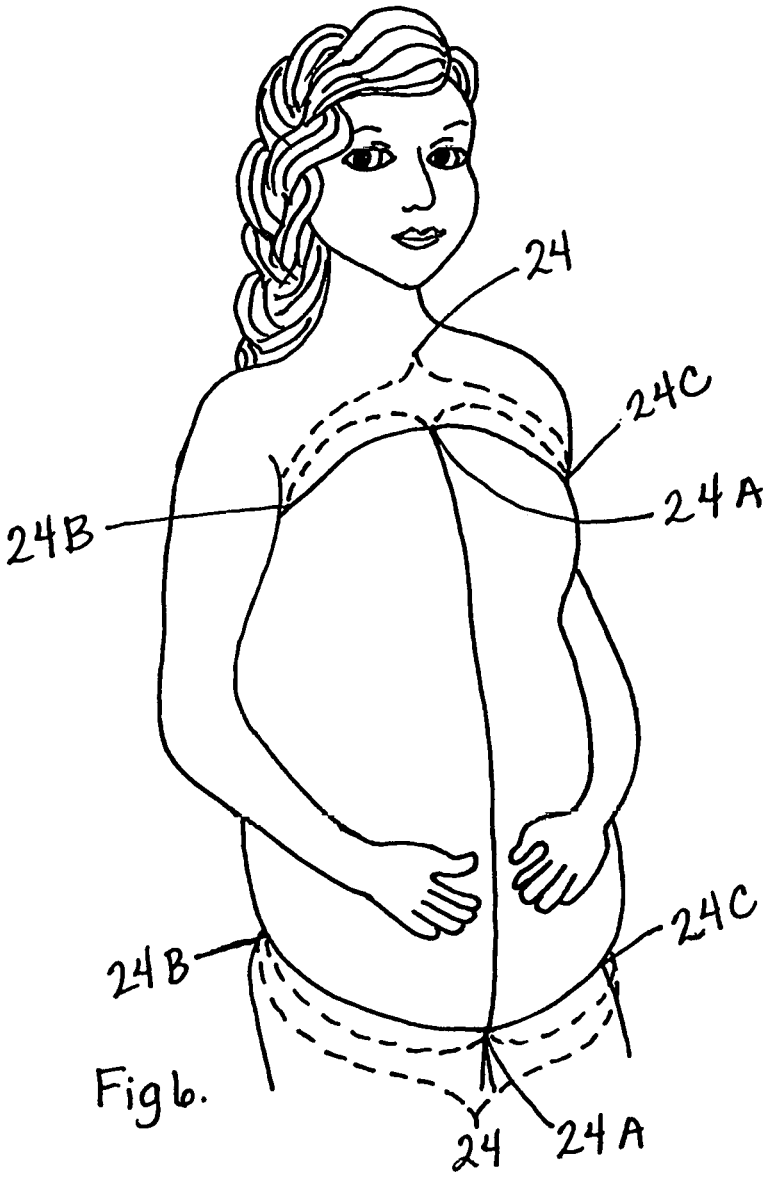
FIG. 6 shows the 3 Point Hinged Arch 24 with the spring lines of support at center 24A, 24B right and 24C left. This is mirrored on the top and bottom of the Swaddle.

FIG. 6 shows the 3 Point Hinged Arch 24 with the spring lines of support at center 24A, 24B right and 24C left. This is mirrored on the top and bottom of the Swaddle. The 3 Point Hinged Arch gives vertical and horizontal support to the upper front for the head and neck of the infant and the lower front supports the infant's feet and legs.

Figure 7:
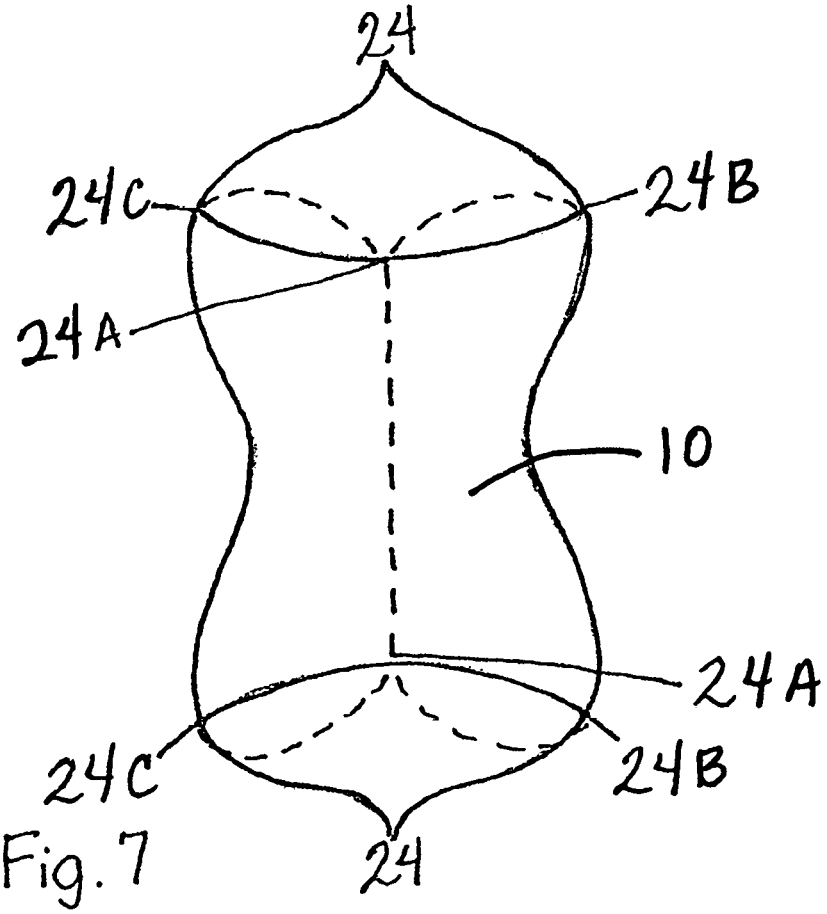
FIG. 7 is a back view of the Swaddle body 10.

FIG. 7 is a back view of the Swaddle body 10. The Three Point Hinged Arch 24 centers on the upper and lower center back. The spring lines of support are 24A at the center, 24B right and 24C left on the upper and lower side of Swaddle body 10.

Figure 8:
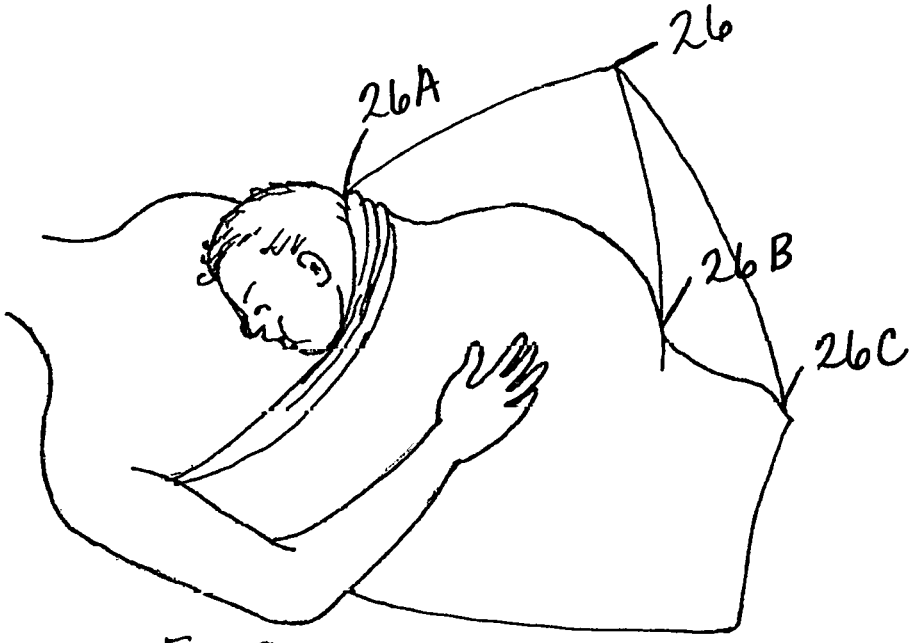
FIG. 8 is a reclined flat view of mother with infant in the Swaddle. This view illustrates how the vertical arched front forms an Arcade of Arches 26 at 26A, 26B and 26C when infant is placed in the Swaddle

FIG. 8 is a reclined flat view of mother with infant in the Swaddle. This view illustrates how the vertical arched front forms an Arcade of Arches 26 at 26A, 26B and 26C when infant is placed in the Swaddle. The spring-line points of the Arcade of Arches 26 are at 26A, which is also the base of infant's neck and head, 26B, which is just beneath the infant's bottom and 26C, which is just beneath the infant's feet. The Arcade of Arches 26 provides additional vertical and horizontal support for the infant.

Figure 9:
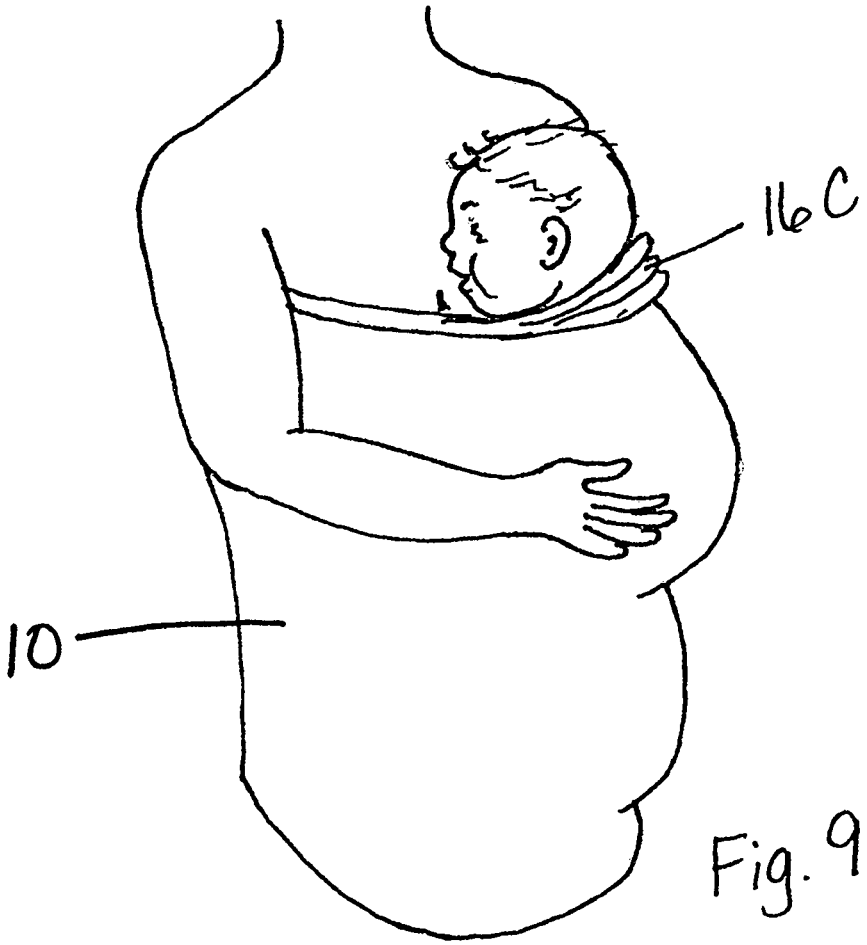
FIG. 9 shows the Cascade of the Convex Arches 16C.

FIG. 9 shows the Cascade of the Convex Arches 16C. These are formed by the expansion of fabric when the infant is placed in the Swaddle body 10 forming a Cascade of Convex Arches 16C. This forms an accordion fold expansion providing the flexible horizontal and vertical support needed for the infant's head and neck in various newborn movements.

Figure 10:
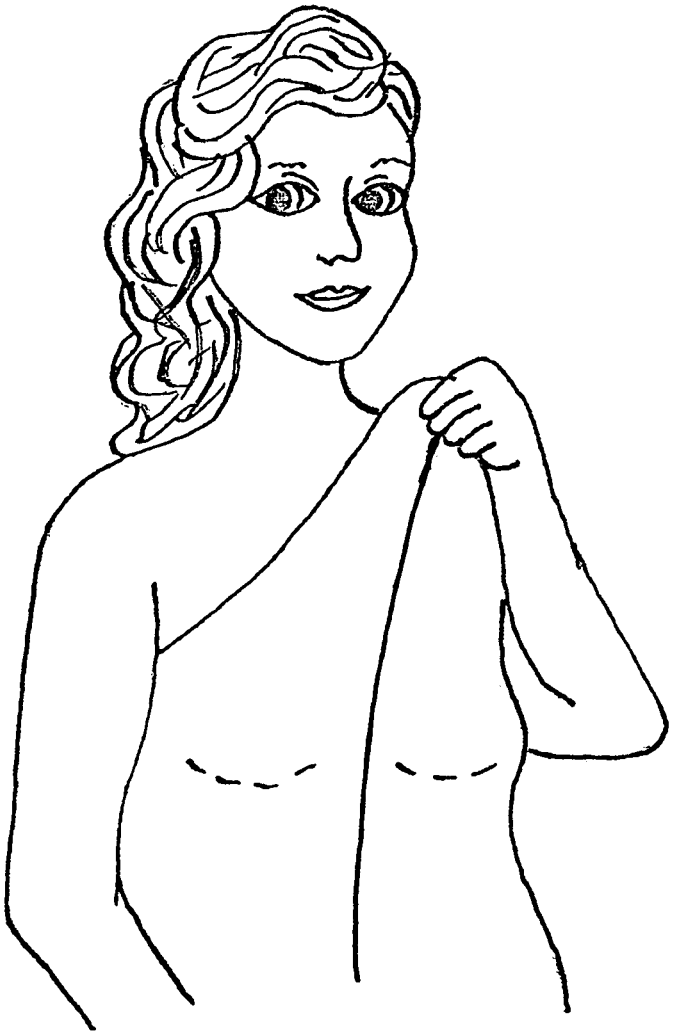
FIG. 10 is a front view illustrating the multi-flex breathe-through fabric and the flexibility of the stretch seam.

FIG. 10 is a front view illustrating the multi-flex breathe-through fabric and the flexibility of the stretch seam. The multi-flex breathe-through fabric enables easy infant movement preventing infant breathing restriction. This stretch of the fabric works in tandem with the arches to safely and flexibly support the positioning of the infant to provide comfort and safety.

Figure 11:
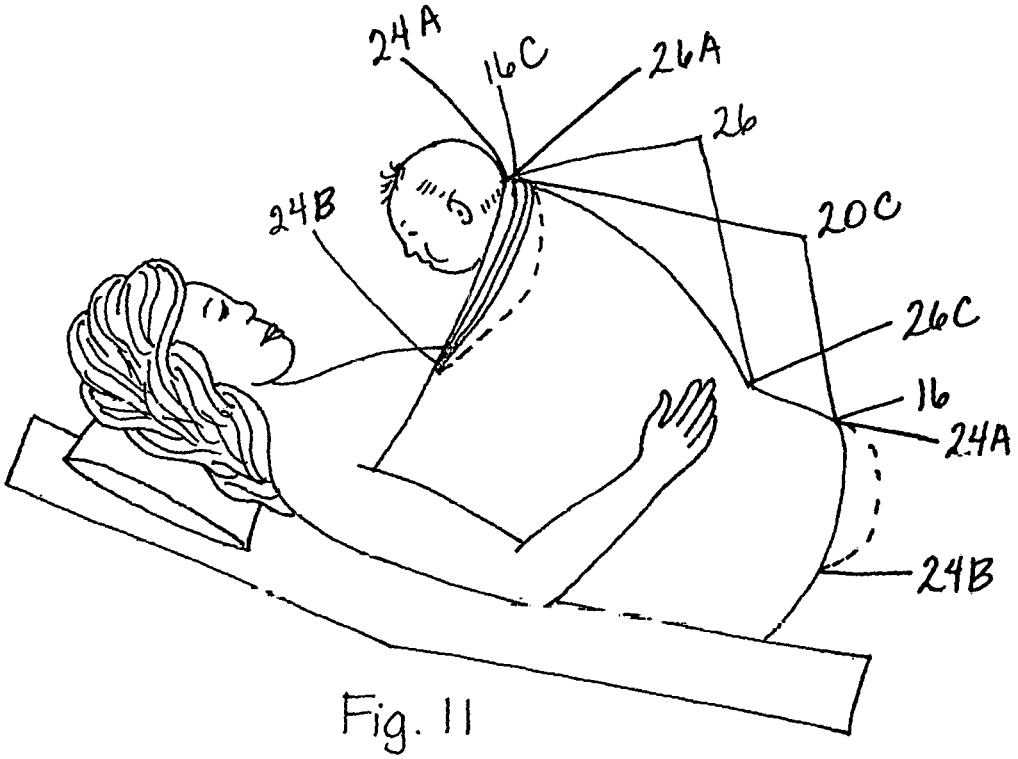
FIG. 11 shows how the Swaddle allows the infant to lunge up to 6" to and from mother's body during the Breast Crawl

FIG. 11 shows how the Swaddle allows the infant to lunge up to 6" to and from mother's body during the Breast Crawl occurring immediately after birth for 60 to 90 minutes. The infant will lunge to and from mother's body 5 to 6 times in his journey to the breast. This activates a number of arches of support, the Circular Arch 20C, the Arcade of Arches 26, with the spring line of support at 26A, 26C, support the torso of the infant. The Convex Cascade of Arches 16C, the 3 Point Hinged Arch 24 with spring lines of support at 24A, 24B, and 24C support the head and neck. These arches work in tandem to support the infant's upper and mid torso. The infant's lower torso is supported by the Circular Arch 20C, Convex Arch 16, the 3 Point Hinged Arch 24 with spring lines of support at 24A, 24B, 24C. These work in tandem to flexibility support the infant's lower torso to prevent flipping and falling.

Figure 12:
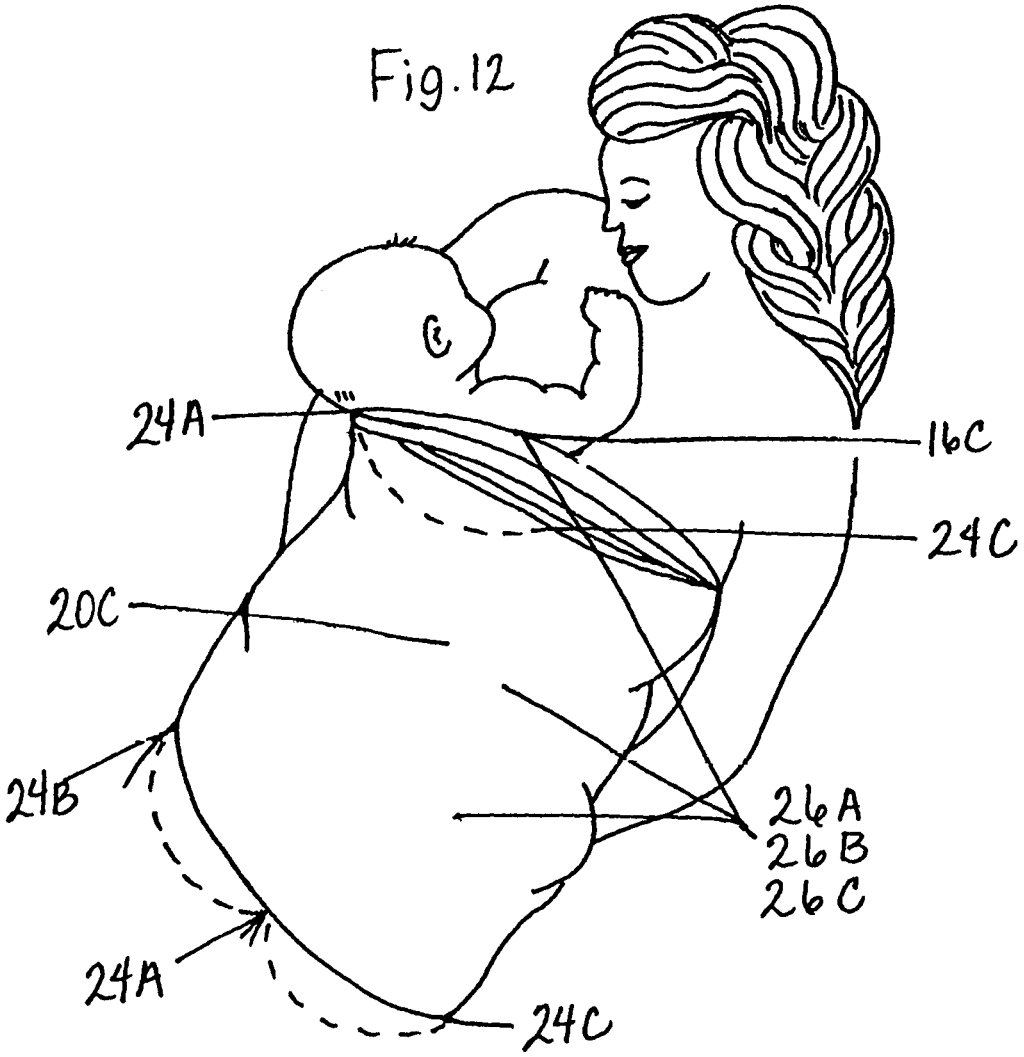
FIG. 12 shows how easy the infant can transition from the upright Skin to Skin position to the breastfeeding position.

FIG. 12 shows how easy the infant can transition from the upright Skin to Skin position to the breastfeeding position. The infant's head and neck are flexibly supported horizontally by the Cascade of Arches 16C that work in tandem with the 3 Point Hinged Arch 24A,B,C, to support the infant on the upper side of the breast, with head and nose in sniffing position. The vertical and horizontal support of The Circular Arch 20C and the Arcade of Arches 26A, 26B, 26C, provide vertical and horizontal support of the infant's torso work in tandem with multi-flex fabric and the stretch seams to allow the torso of the infant to easily move without sliding down into the body of the Swaddle. The length of the Swaddle Body 10 completely covers and supports the infant when infant's torso is fully extended and parallel to mother. The Convex Arch 16 and the 3 Point Hinged Arch 24, at 24A, 24B, 24C, flexibly supports the infant's feet and legs to promote successful breastfeeding.

Figure 13:
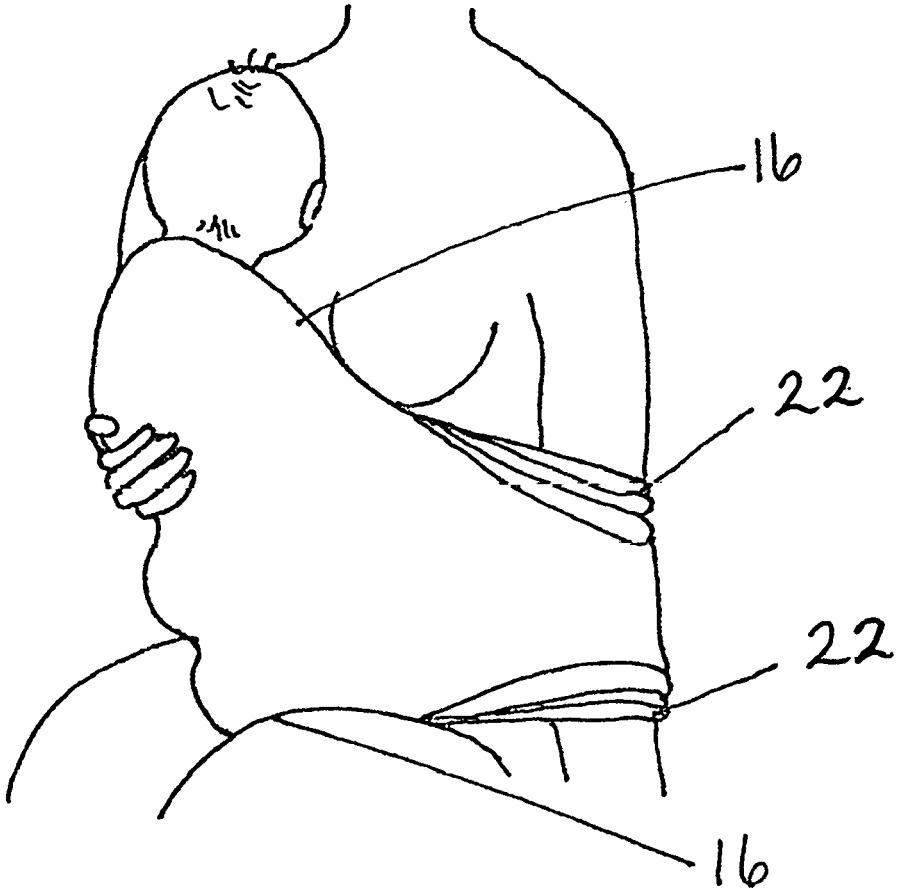
FIG. 13 is a side view of mother sliding one side of the Swaddle up on the shoulder to hold infant in the sling position

FIG. 13 is a side view of mother sliding one side of the Swaddle up on the shoulder to hold infant in the sling position. The Parallel Arches 22 of the upper and lower sides pivot between the Concave Arch 18 of the back and the Convex Arch 16 of the front on both the upper and lower sides for easy and comfortable movement of the Swaddle to the shoulder position.

Figure 14:
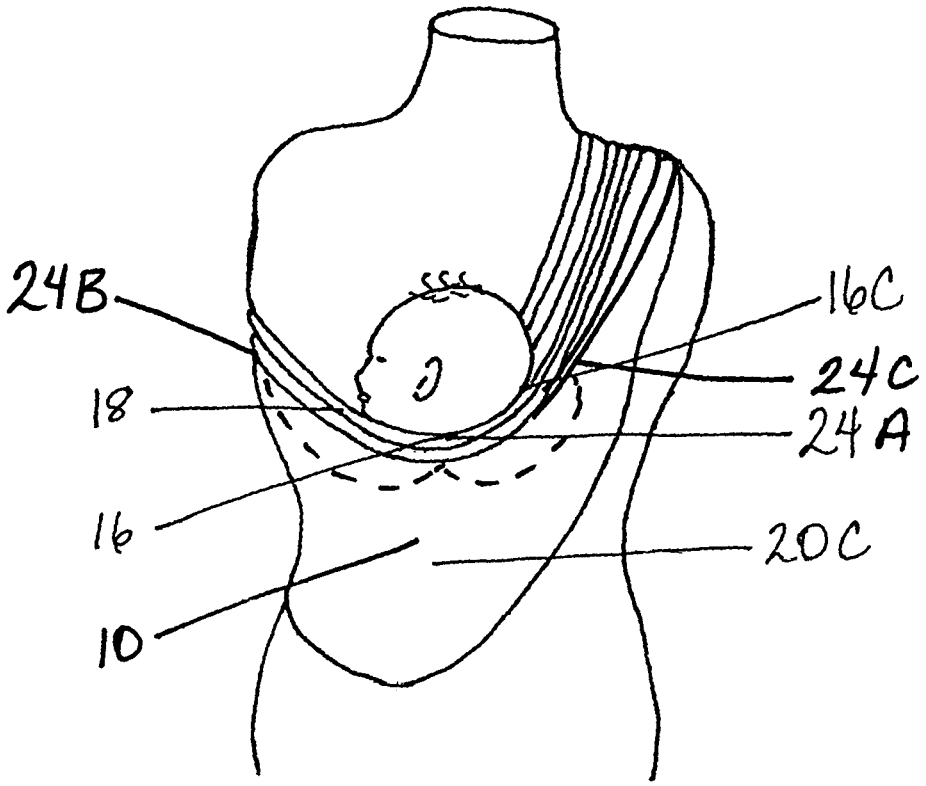
FIG. 14 shows the placement of the Swaddle on shoulder which forms the pouch in body 10.

FIG. 14 shows the placement of the Swaddle on shoulder which forms the pouch in body 10. The weight of the infant and the tension placed on the shoulder side of the Swaddle tighten the Convex Arches 16 of the upper and lower fronts of the Swaddle to form a pouch. This pouch evenly distributes the weight of the infant due the Circular Arch 20C, the multi-flex fabric and the arched stretch seam. The Cascade of Convex Arches 16C are formed in accordion like folds support infant's neck and head for easy and safe movement.

Figure 15:
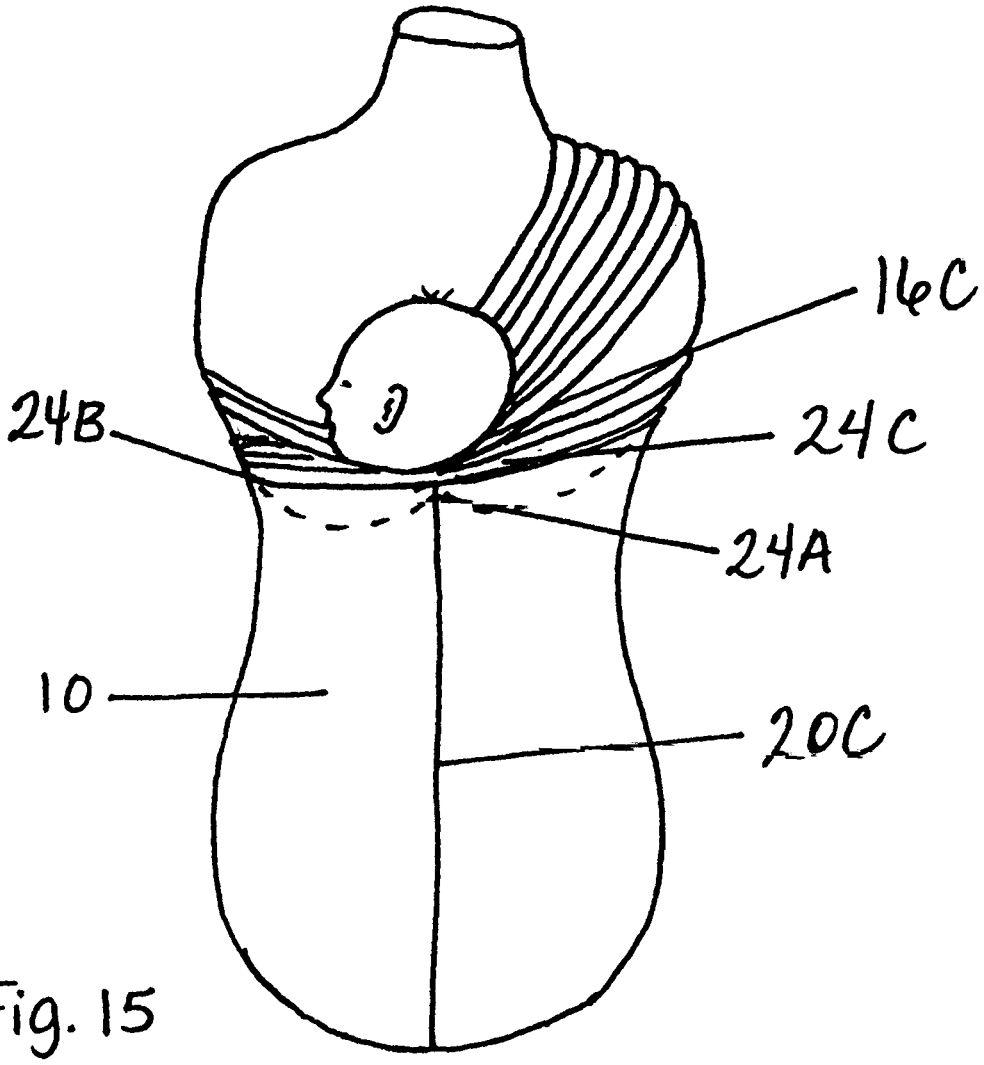
FIG. 15 shows a second Swaddle placed over the first and spread over infant with the vertical arched seam in the front pulled up behind infant's neck and completely covering mother's torso forming the Circular Arch 20C.

FIG. 15 shows a second Swaddle placed over the first and spread over infant with the vertical Arched seam in the front pulled up behind infant's neck and completely covering mother's torso forming the Circular Arch 20C; the 3 Point Hinged Arch 24 is activated in the center front of both sections. The Convex Cascade of Arches 16C is formed in both sections giving additional support for infant's head and neck. This second Swaddle gives more support for mother to have freedom of movement and complete coverage of her torso.

Figure 16:
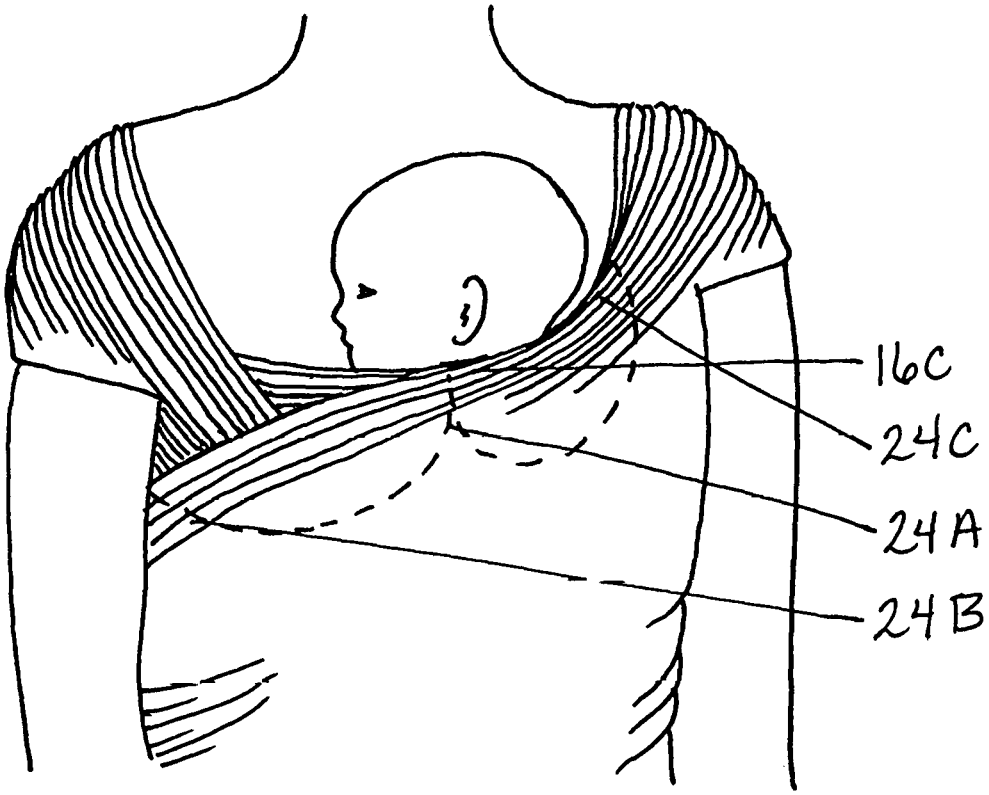
FIG. 16 shows the Second Swaddle pulled up on opposite shoulder forming a second pouch over the first pouch as in FIG. 14.

FIG. 16 shows the Second Swaddle pulled up on opposite shoulder forming a second pouch over the first pouch as in FIG. 14. The Convex Cascade of Arches 16C, the 3 Point Hinged Arch. The two Swaddles give the support needed for the infant to be carried and allow mother to be hands free. The twist in the shoulder tightens the edges of the Convex Arches.

Figure 17:
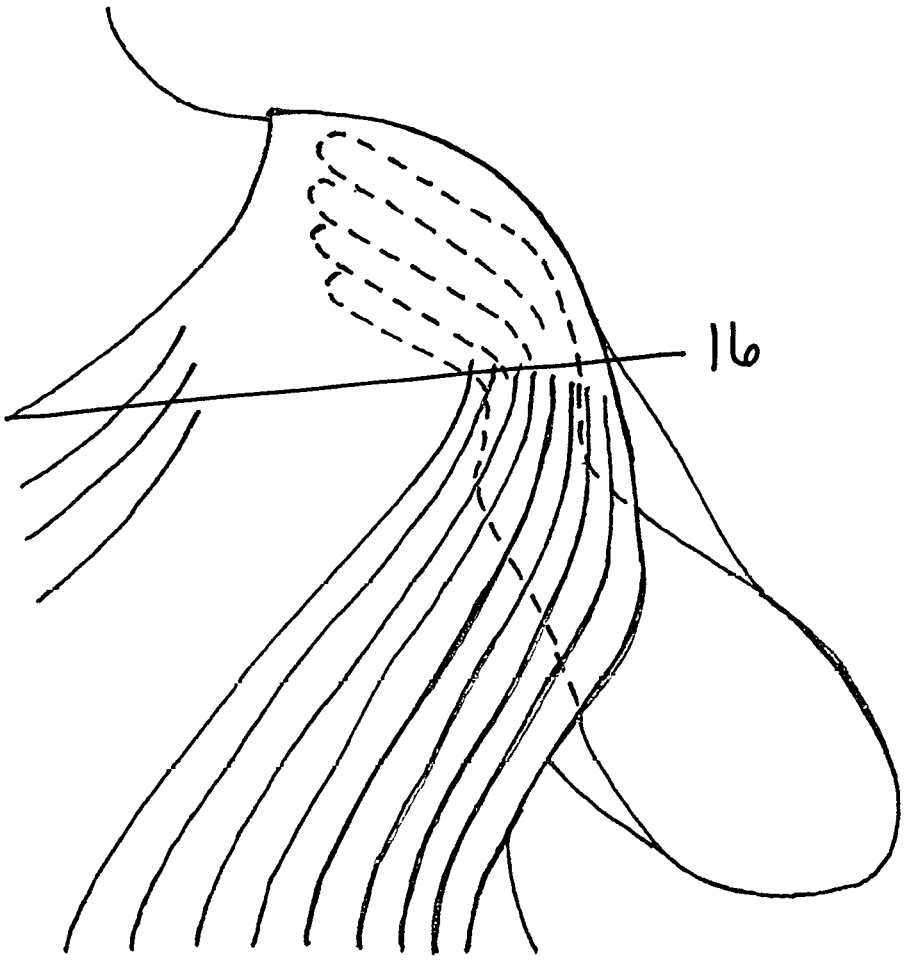
FIG. 17 demonstrates how a twist is formed in the shoulder fabric to tighten the upper and lower edges of the front Convex Arches 16.

FIG. 17 demonstrates how a twist is formed in the shoulder fabric to tighten the upper and lower edges of the front Convex Arches 16. This is done by sliding your hand under the shoulder fabric and grasping the inside edge of the fabric and pulling it under the shoulder to form a twist. This tightens the front edges of the Convex Arches 16 of the upper and lower Swaddle fronts.

Figure 18:
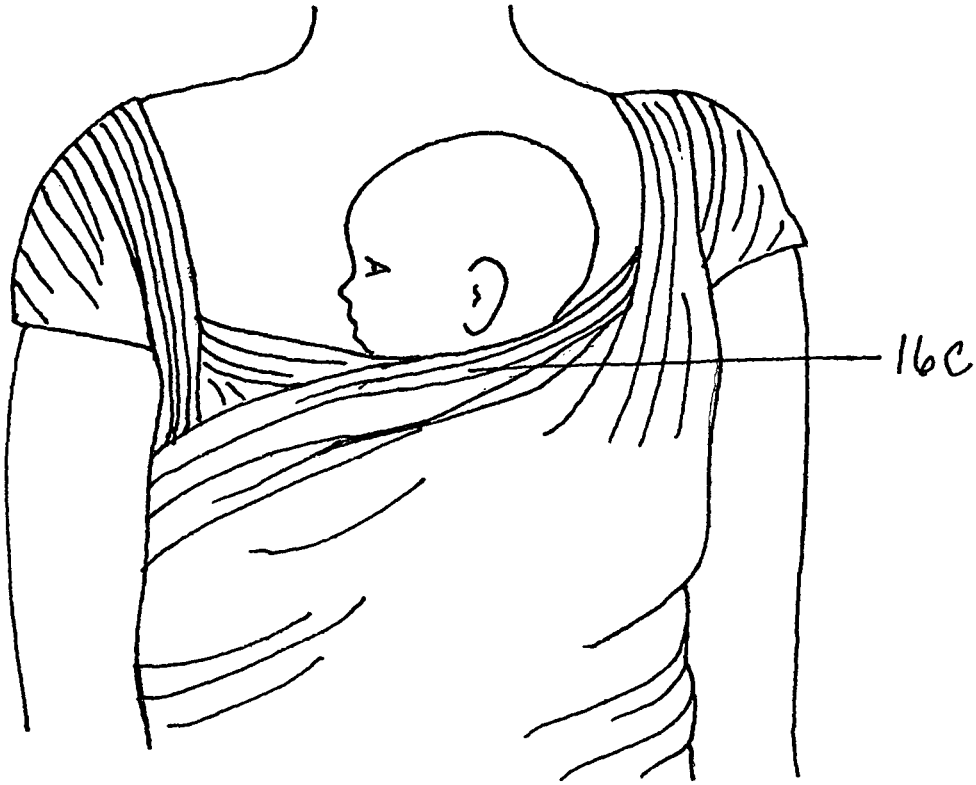
FIG. 18 shows the twist in both shoulders and the Cascade of Convex Arches 16C are activated in both the Swaddles.

FIG. 18 shows the twist in both shoulders and the Cascade of Convex Arches 16C are activated in both the Swaddles.

Figure 19:
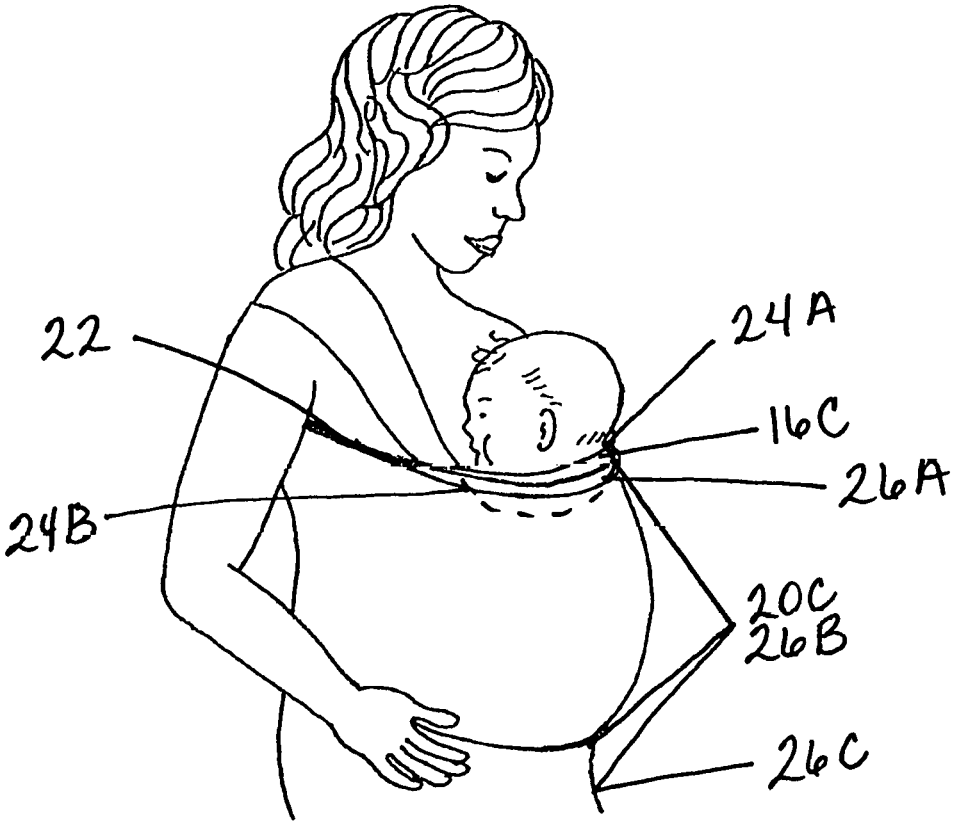
FIG. 19 shows mother with infant in a hands-free hold with pouches formed in both swaddles

FIG. 19 shows mother with infant in a hands-free hold with pouches formed in both swaddles by the weight of the infant and the tension placed on the Convex Arches 16 when the Swaddle is placed on the shoulder. The Circular Arch 20C works in tandem with the Parallel Arches, the Arcade of Arches 26A, 26B and 26C, the multi-stretch fabric and stretch seam to give even weight distribution without creating pressure points. The Cascade of Convex Arches 16C in combination with the 3 Point Hinged Arches 24 provides flexible support for the infant's neck and head.

Figure 20:
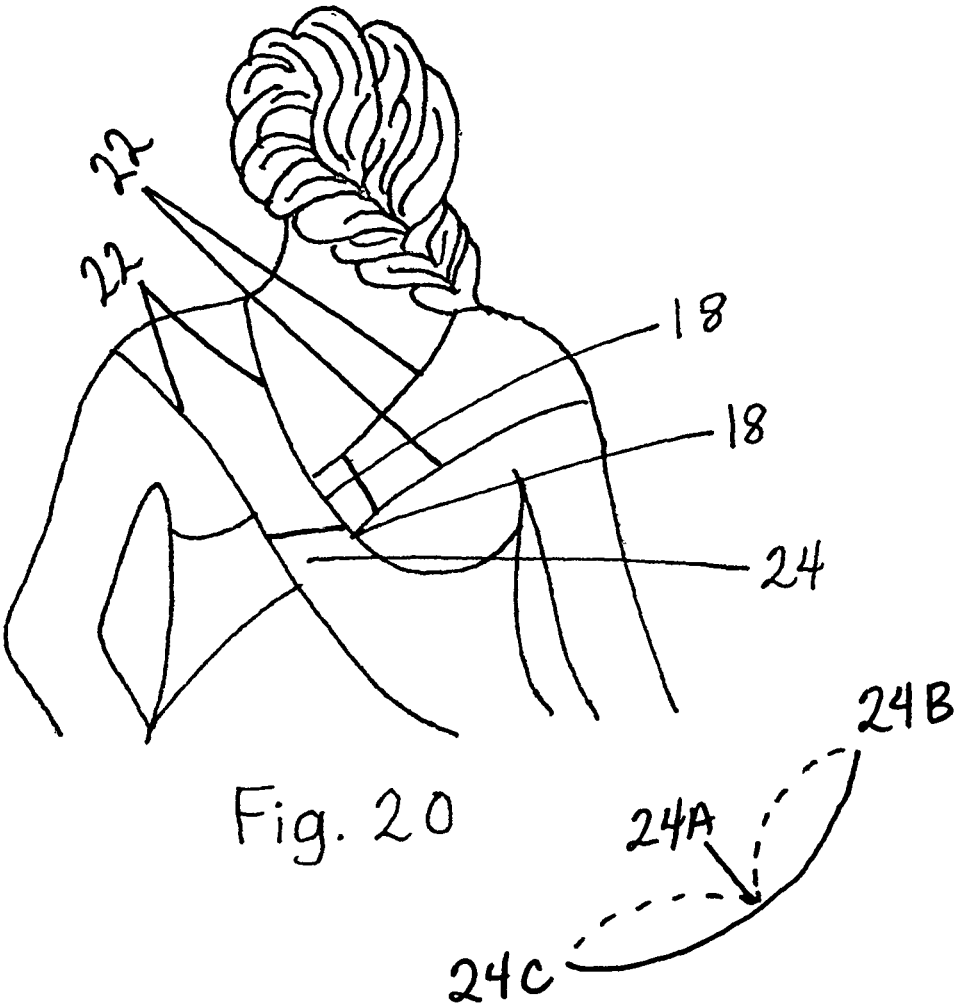
FIG. 20 shows the back of the Swaddle when two sections are worn.

FIG. 20 shows the back of the Swaddle when two sections are worn. The Parallel Arches 22 of the upper and lower sides pivot between the Concave Arch 18 of the back and the Convex Arch 16 of the front on both the upper and lower sides for easy and comfortable movement of the Swaddle to the shoulder position. The 3 Point Hinged Arches 24 of the upper and lower back, allow easy movement for comfort and support in the crossover back.

Figure 21:
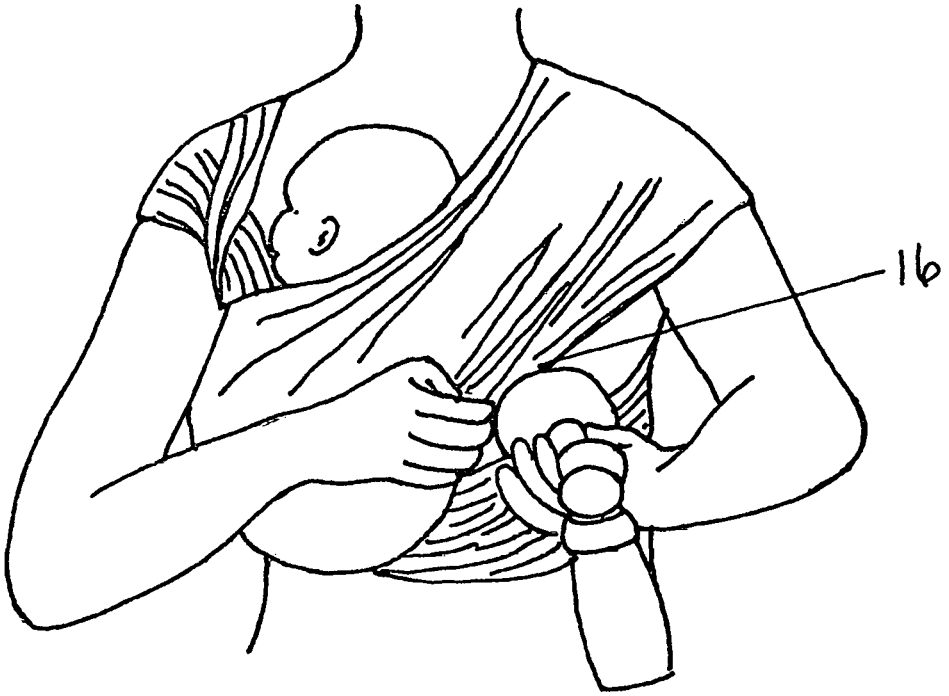
FIG. 21 shows the placement of the flanges of the breast pump hands free on one or both sides with or without infant.

FIG. 21 shows the placement of the flanges of the breast pump. This is possible because of the Convex Arches 16 of the upper and lower edges, are tightened when the Swaddle sections are placed on the shoulder. These edges hold the flanges in place when two Swaddles are placed in the crossover position. Mother can pump hands free on one or both sides with or without infant.

Figure 22:
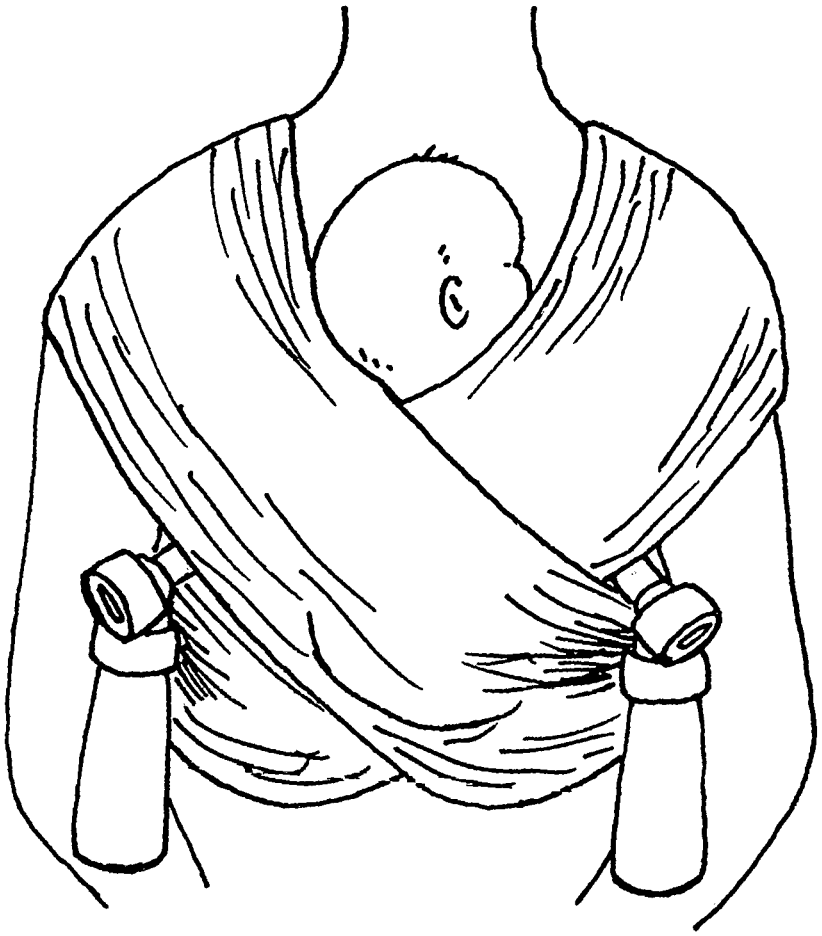
FIG. 22 shows the placement of two flanges of the breast pump.

FIG. 22 shows the placement of two flanges of the breast pump. Mother can pump hands free with or without the infant.

Figure 23:
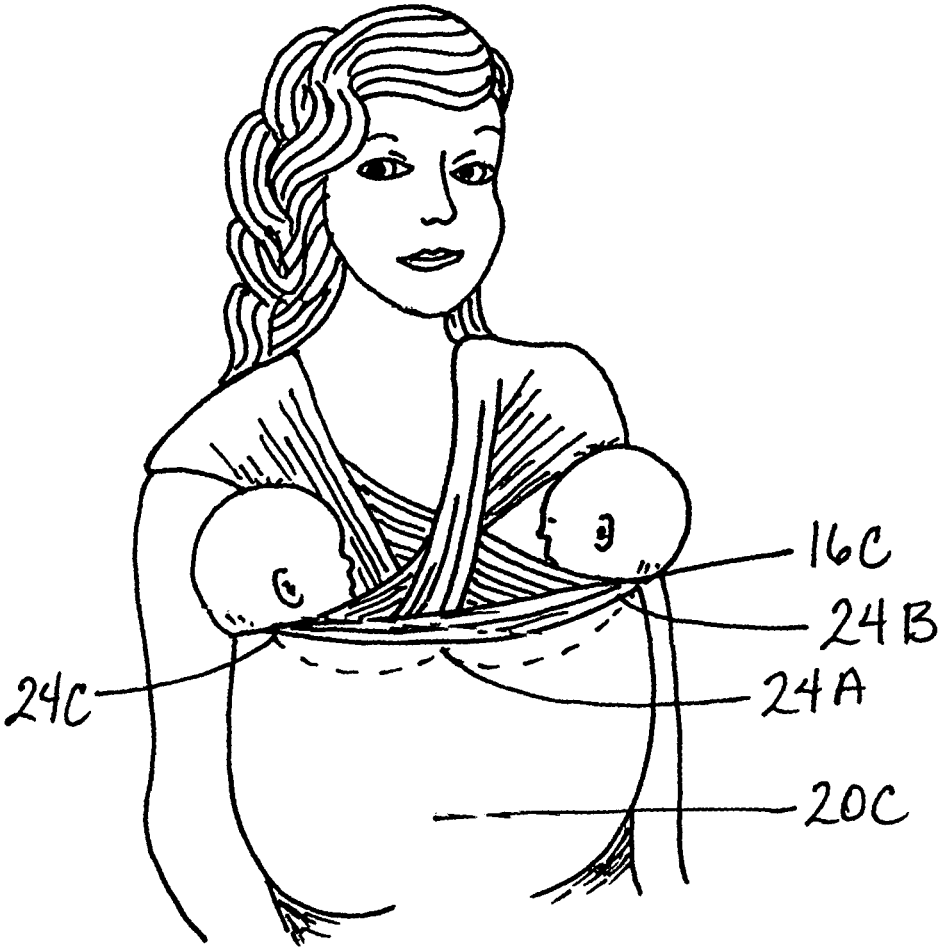
FIG. 23 shows the addition of the third Swaddle section to hold twins.

FIG. 23 shows the addition of the third Swaddle section to hold twins.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters of Patent is presented in the subsequently appended claims.

What is claimed is:

1. An upper body baby carrier comprising a first asymmetric tubular piece and a second asymmetric tubular piece, each sized to fit around a person's trunk, wherein each asymmetric tubular piece comprises:

a stretchable fabric forming the wall of the tubular piece;

a first side of the wall having a first length and a second side of the wall having a second length, where the first side is opposite the second side and where the second length is greater than the first length, wherein the wall comprises a first end, a second end, and a mid-region located between the first end and the second end, wherein the circumference of the wall at the mid-region is greater than the circumference of the wall at the first end and the second end.

2. The upper body baby carrier of claim 1, wherein the second length is at least 15 inches.

3. The upper body baby carrier of claim 2, wherein the wall comprises two panels of fabric which are connected to each other at a first scam and a second seam, where the first seam is a straight seam and the second seam is a curved seam.

4. A method of carrying a baby comprising:

obtaining an upper body baby carrier of claim 1;

positioning the first asymmetric tubular piece on a body such that the first side of the wall is positioned above a right shoulder and the second side is positioned underneath the left shoulder, wherein the trunk of the body is positioned in the interior space of the first tubular piece; and positioning the second asymmetrical tubular piece on the body such that the first side of the wall is positioned above the left shoulder and the second side is positioned below the right shoulder, wherein the trunk of the body is positioned in the interior space of the second tubular piece;

placing a baby between the body and the walls of the first and second tubular pieces.

5. An upper body baby carrier consisting of a first asymmetric tubular piece and a second asymmetric tubular piece, each: sized to fit around a person's trunk, wherein each asymmetric tubular piece comprises: a stretchable fabric forming the wall of the tubular piece; a first side of the wall having a first length and a second side of the wall having a second length, where the first side is opposite the second side and where the second length is greater than the first length; wherein the wall comprises a first end, a second end, and a mid-region located between the first end and the second end, wherein the circumference of the wall at the mid-region is greater than the circumference of the wall at the first end and the second end; and wherein the second length is 2 times greater than the first length.

6. An upper body baby carrier comprising a first asymmetric tubular piece, a second asymmetric tubular piece, and a third asymmetrical piece, each sized to fit around a person's trunk, wherein each asymmetric tubular piece comprises:

a stretchable fabric forming the wall of the tubular piece;

a first side of the wall having a first length and a second side of the wall having a second length, where the first side is opposite the second side and where the second length is greater than the first length.

7. An upper body baby carrier consisting of a first asymmetric tubular piece and a second asymmetric tubular piece, each: sized to fit around a person's trunk, wherein each asymmetric tubular piece comprises: a stretchable fabric forming the wall of the tubular piece; a first side of the wall having a first length and a second side of the wall having a second length, where the first side is opposite the second side and where the second length is greater than the first length; wherein the wall comprises a first end, a second end, and a mid-region located between the first end and the second end, wherein the circumference of the wall at the mid-region is greater than the circumference of the wall at the first end and the second end; and wherein the wall comprises two panels of fabric which are connected to each other at a first seam and a second seam, where the first seam is a straight seam and the second seam is a curved seam.

* * * * *